US010508799B2

(12) United States Patent
McRae

(10) Patent No.: US 10,508,799 B2
(45) Date of Patent: Dec. 17, 2019

(54) IN-TUBE BATTERY TREE

(71) Applicant: National Tree Company, Cranford, NJ (US)

(72) Inventor: Michael M. McRae, Ormond Beach, FL (US)

( * ) Notice: Subject to any disclaimer, the term of this patent is extended or adjusted under 35 U.S.C. 154(b) by 0 days.

(21) Appl. No.: 16/102,457

(22) Filed: Aug. 13, 2018

(65) Prior Publication Data

US 2018/0356084 A1 Dec. 13, 2018

Related U.S. Application Data

(63) Continuation-in-part of application No. 15/468,747, filed on Mar. 24, 2017.

(51) Int. Cl.

| | |
|---|---|
| ***A41G 1/00*** | (2006.01) |
| ***F21V 23/00*** | (2015.01) |
| ***F21L 4/08*** | (2006.01) |
| ***F21V 23/02*** | (2006.01) |
| ***F21S 4/10*** | (2016.01) |
| ***A47G 33/06*** | (2006.01) |

(52) U.S. Cl.

CPC ..... *F21V 23/009* (2013.01); *A47G 33/06* (2013.01); *F21L 4/08* (2013.01); *F21S 4/10* (2016.01); *F21V 23/023* (2013.01)

(58) Field of Classification Search

CPC .... F21V 23/009; F21V 23/023; F21V 17/002; F21V 17/005; F21S 4/10; F21S 4/001; F21S 2/00; F21S 61/00; F21S 13/12; F21L 4/08; A41G 1/004; A41G 1/005

USPC ..... 362/122, 123, 183, 196, 200, 224, 225, 362/652, 249.18, 249.19

See application file for complete search history.

(56) References Cited

U.S. PATENT DOCUMENTS

| | | | | |
|---|---|---|---|---|
| 6,830,357 | B2 * | 12/2004 | Lopez | B60Q 1/2661 362/122 |
| 7,852,204 | B2 * | 12/2010 | Lai | B60Q 1/2607 340/453 |
| 8,398,269 | B1 * | 3/2013 | Loomis | F21L 4/02 362/249.16 |

(Continued)

*Primary Examiner* — William J. Carter
*Assistant Examiner* — Omar Rojas Cadima
(74) *Attorney, Agent, or Firm* — Ellenoff Grossman & Schole LLP; James M. Smedley; Alex Korona

(57) ABSTRACT

Apparatus and associated methods relate to a lighted tree formed from a tree trunk section retaining a battery holder, branches extending from the trunk section, a light source disposed to emit light from a branch and electrically connected to the trunk section, and a base, adapted to mechanically support the trunk section and electrically connect the battery holder to an energy source external to the trunk section. In an illustrative example, the light source may be an LED-illuminated optic fiber. In some embodiments, the energy source may be a photovoltaic collector or multifrequency energy harvester. In some designs, the battery holder may adaptively maintain electrical polarity independent of battery orientation. In various implementations, battery holders may be stacked or rotated to one another to configure parallel or series batteries. Various embodiments may advantageously retain batteries in rotationally interconnected tree sections for common charging, or single in-tube section for smaller trees.

17 Claims, 16 Drawing Sheets

(56) References Cited

U.S. PATENT DOCUMENTS

| | | | | |
|---|---|---|---|---|
| 2010/0097744 | A1* | 4/2010 | Auvil | A47G 33/06<br>361/679.01 |
| 2012/0076957 | A1* | 3/2012 | Chen | F21V 21/002<br>428/8 |
| 2015/0084515 | A1* | 3/2015 | Altamura | H05B 37/029<br>315/131 |

* cited by examiner

IN-TUBE BATTERY TREE

CROSS-REFERENCE TO RELATED APPLICATIONS

This application is a continuation-in-part of U.S. Non-Provisional Utility patent application Ser. No. 15/468,747, filed on Mar. 24, 2017 and entitled "BATTERY-POWERED TREE," the entire contents of which is hereby incorporated herein by reference.

TECHNICAL FIELD

Various embodiments relate generally to illuminated artificial trees.

BACKGROUND

Artificial trees are trees that are not natural trees. Artificial trees do not occur as a product of nature. Artificial trees are a product of human construction activity. Some artificial trees may have a trunk and branches approximating the form of a natural tree. Artificial trees may be displayed in place of a natural tree. An artificial tree may be constructed from a variety of materials. Constructing an artificial tree from some materials may aid conservation of the natural environment. For example, some artificial trees may be constructed from plastic or metal. Artificial trees may be constructed to various heights. Some artificial trees may be very tall.

Users of artificial trees include individuals and organizations. Users may employ artificial trees to display decoration for a special occasion. Many artificial trees are illuminated with visible light. Artificial trees may display visible lights located in various parts of the tree, including the trunk or branches. Some artificial trees display many lights. Some artificial trees may display various groups of lights at different times. For example, the lights displayed by some artificial trees may be turned on and off in groups to display various lighting patterns. In some artificial trees, lighting patterns may include multiple lights of various colors at different times. Some artificial trees employ a single light in the base of the tree. Optical fibers may couple a light in the base to the trunk or branches. Lights may be dim near the top of taller trees with long optical fibers coupled to a light in the base of the tree, due to optical loss in the long optical fiber. Some artificial trees change the displayed lighting color over time by directing the light through a rotating color wheel.

An artificial tree may require significant electrical energy. Very tall artificial trees may have many lights. An artificial tree with many lights may consume more energy and cost more to operate than a shorter tree with fewer lights. The illumination in some artificial trees may remain active for extended periods of time. For example, an artificial tree employed by a retail business storefront may remain active for several months. An artificial tree with many lights may consume more electrical energy. Artificial trees employing a motorized rotating color wheel may require additional electrical energy to rotate the color wheel. Increased consumption of electrical energy to illuminate lights in an artificial tree may impact the environment and increase the operating cost of the tree.

Some artificial trees may be powered from various electrical energy sources. Some artificial trees may be battery powered. In some examples, a battery-powered artificial tree may be configured with a rechargeable battery. An artificial tree illuminated for a long time may require many batteries consuming significant space. In some scenarios, the power cords or battery of a powered artificial tree may reduce a user's enjoyment of the tree. For example, an artificial tree's batteries or power cord may be in view and reduce the artificial tree's visual appeal. In an illustrative example, the batteries or power cord may conflict with user activity near the tree, perhaps even becoming a safety hazard.

SUMMARY

Apparatus and associated methods relate to a lighted tree formed from a tree trunk section retaining a battery holder, branches extending from the trunk section, a light source disposed to emit light from a branch and electrically connected to the trunk section, and a base, adapted to mechanically support the trunk section and electrically connect the battery holder to an energy source external to the trunk section. In an illustrative example, the light source may be an LED-illuminated optic fiber. In some embodiments, the energy source may be a photovoltaic collector or multifrequency energy harvester. In some designs, the battery holder may adaptively maintain electrical polarity independent of battery orientation. In various implementations, battery holders may be stacked or rotated to one another to configure parallel or series batteries. Various embodiments may advantageously retain batteries in rotationally interconnected tree sections for common charging, or single in-tube section for smaller trees.

Apparatus and associated methods relate to a battery-powered lighted tree formed from an artificial tree trunk adapted to be mechanically supported and electrically connected to a support structure external to the tree, artificial tree branches extending from the trunk, a light source disposed to emit light from a branch and electrically connected to the trunk, and, a base, formed from a battery, and, a structure adapted to mechanically support the trunk and electrically connect the trunk to the battery. In an illustrative example, the light source may be an LED-illuminated optic fiber. In some embodiments, the battery may be charged from a solar cell. Some designs may provide customizable illumination patterns using a programmable controller adapted to control the light source. Various embodiments may advantageously operate from battery for a seasonal display, for example, using lights and battery selected to provide a sufficient period of illumination each display season day.

Various embodiments may achieve one or more advantages. For example, some embodiments may provide longer-lasting illumination of a lighted artificial tree. This facilitation may be a result of extending the artificial tree's energy used for illumination based on connecting the battery holder to an energy source external to the trunk section. Some implementations may provide extended artificial tree illumination at reduced operating cost. Such low cost lighted artificial tree extended illumination may be a result of supplementing the artificial tree power source with harvested ambient energy. Some embodiments may reduce negative impact to the Earth's natural environment. Such reduced environmental impact may be a result of reducing the number of batteries manufactured and discarded. For example, a lighted artificial tree powered at least in part by harvested energy from a photovoltaic collector or multifrequency energy harvester for a given illumination duty cycle may require fewer batteries discarded into landfills. In some examples, a user's effort installing artificial tree batteries may be reduced. Such reduced battery installation effort may be a result of a battery holder that adaptively maintains electrical polarity independent of battery orientation. For example, in some embodiments, an exemplary battery holder may retain batteries right-side up, or up-side down, and still maintain polarity. Various designs may increase the available battery configuration range useful to operate a lighted artificial tree. Such increased battery configuration range may be a result of a battery holder design that may be stacked to have the batteries in parallel or series, by simply rotating the holders to one another. Some embodiments may reduce a user's time recharging lighted artificial tree batteries. Such reduced lighted artificial tree battery recharging time may be a result of batteries configured in the tree sections, with the sections interconnected for common charging. Various designs may increase the user's safety or enjoyment of living space near a lighted artificial tree. This facilitation may be a result of retaining batteries in a holder located in a tree trunk section, such that the batteries are not in the way or visible. In an illustrative example, a small tree may safely retain a single set of batteries out of sight within the tree stand tube.

Some embodiments may reduce the cost associated with displays having many illuminated artificial trees. This facilitation may be a result of powering an illuminated tree from solar energy. In some examples, a user's effort to maintain a battery-operated illuminated tree may be reduced. Such reduction of maintenance effort may be a result of an illuminated tree powered from a battery adapted to provide a sufficient period of illumination each display season day. Some embodiments may supply battery power to a user's existing illuminated artificial tree. This facilitation maybe a result of adapting a support structure to connect the artificial tree to a battery in the support structure. For example, an artificial tree base retaining a battery may be electrically connected to an existing artificial tree.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 14:
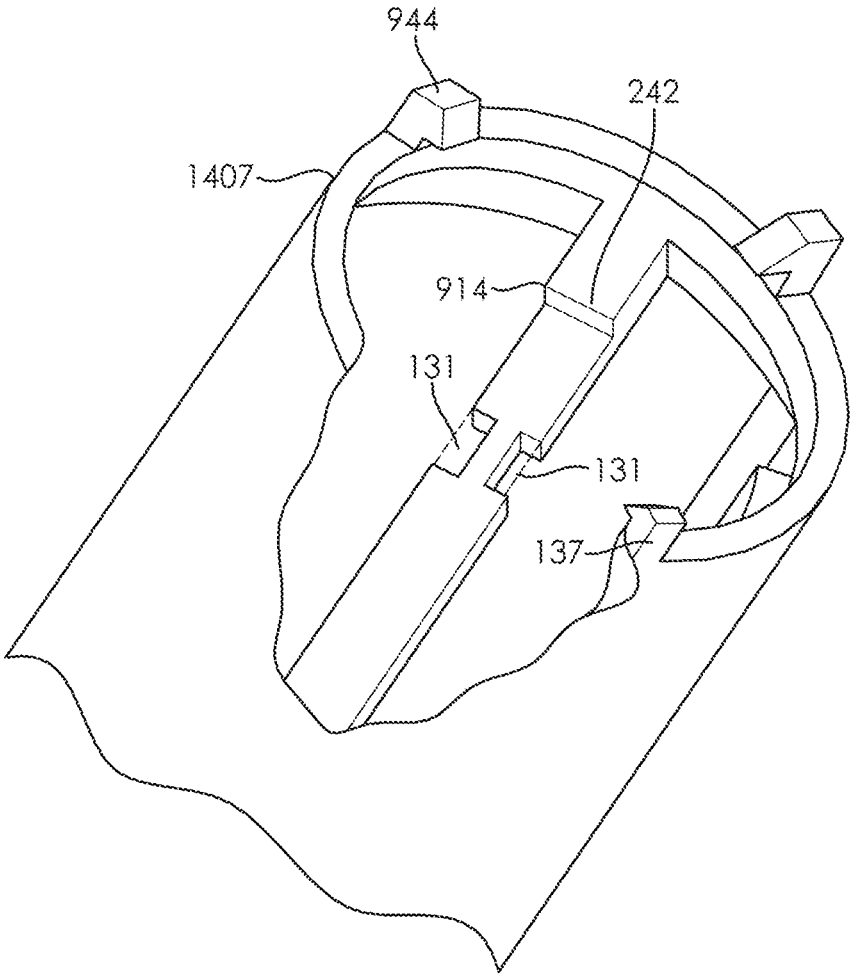
FIG. 14 depicts a side perspective cross-sectional view of an exemplary battery compartment tube.
Figure 15:
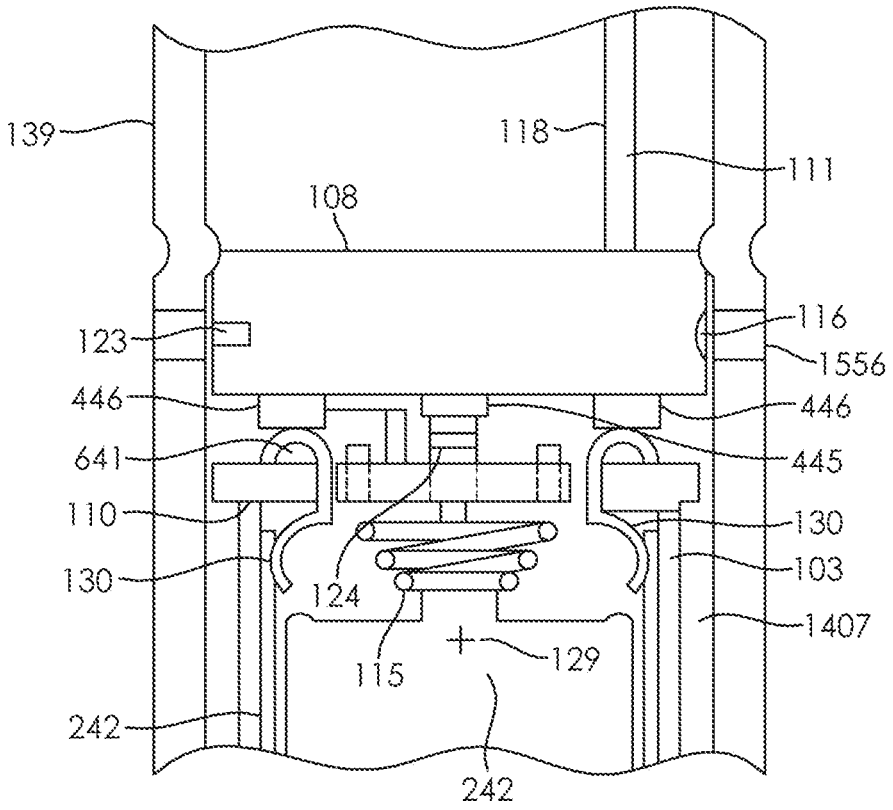
FIG. 15 depicts a side cross-sectional view of an exemplary tree trunk section tube retaining an exemplary battery compartment tube.

To aid understanding, this document is organized as follows. First, an exemplary lighted artificial tree is briefly introduced with reference to FIG. 1. Then, with reference to FIGS. 2-12, the discussion turns to exemplary embodiments that illustrate lighted artificial tree structural and electrical design. Specifically, illustrative artificial tree assemblies and electrical schematics exemplary of various implementations of a lighted artificial tree including tree trunk sections adapted to retain a battery are disclosed. Then, with reference to FIGS. 13-15, illustrative designs of exemplary lighted artificial tree battery holders and tree trunk section tubes are described. Finally, with reference to FIG. 16, illustrative examples of exemplary battery compartment connection combinations are disclosed.

Figure 1:
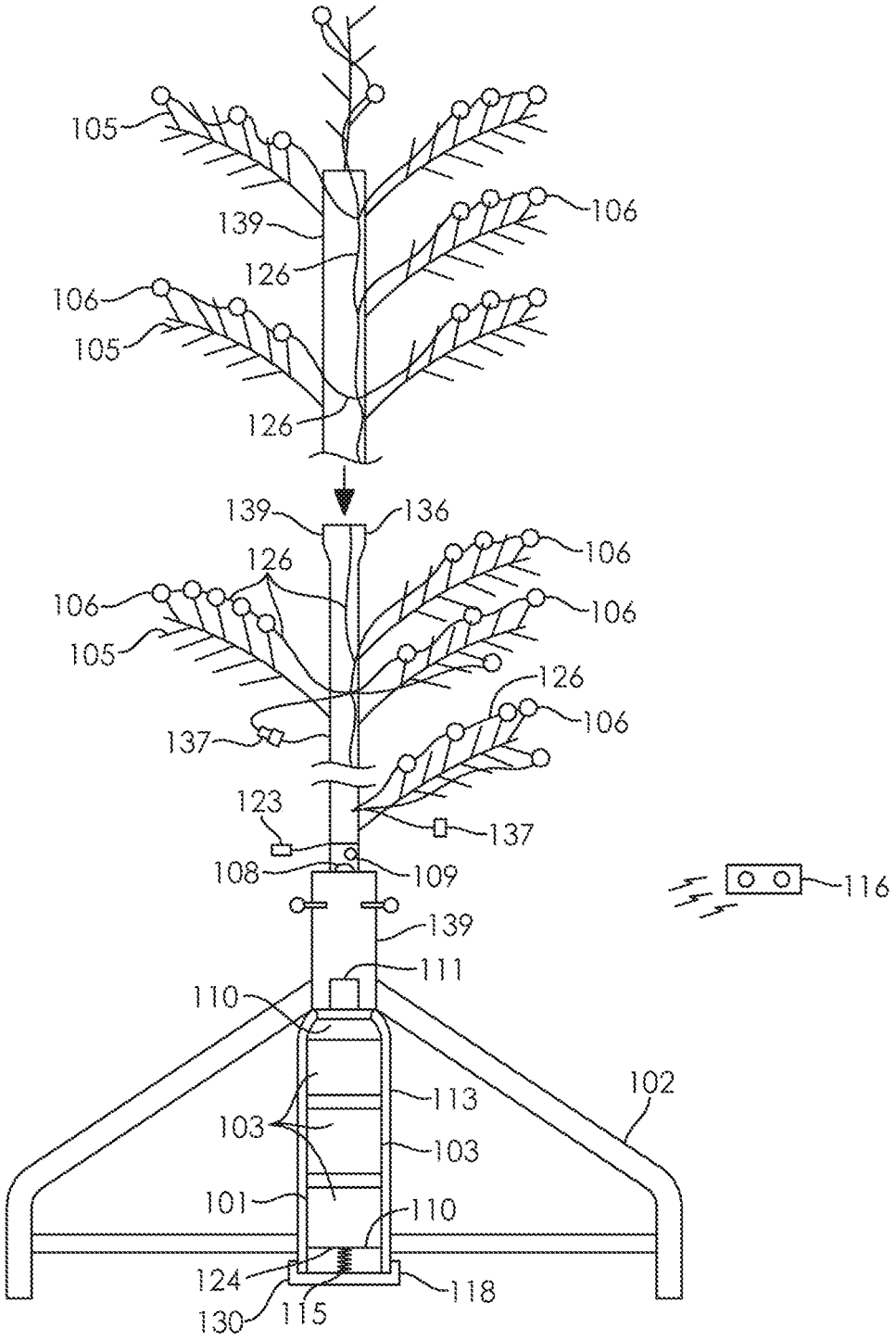
FIG. 1 depicts an exemplary lighted tree formed from a tree trunk section retaining a battery holder, branches extending from the trunk section, a light source disposed to emit light from light strings attached to branches and electrically connected to the trunk section, and a base, adapted to mechanically support the trunk section and electrically connect the battery holder to an energy source external to the trunk section.

FIG. 1 depicts an exemplary lighted tree formed from a tree trunk section retaining a battery holder, branches extending from the trunk section, a light source disposed to emit light from light strings attached to branches and electrically connected to the trunk section, and a base, adapted to mechanically support the trunk section and electrically connect the battery holder to an energy source external to the trunk section. In FIG. 1, the depicted embodiment lighted tree includes branches 105 configured with LEDs 106 arranged to emit light from the lighted tree strings 126 attached to branches 105. The illustrated embodiment lighted tree includes battery container assembly 101 retaining batteries 103 housed in the tree stand tube 113. In the illustrated embodiment, the lighted tree is mechanically supported by the tree stand 102. In the depicted embodiment, the batteries 103 are secured in the battery container assembly 101 by the end caps 110, where the end caps include contact springs 115, battery holder contacts 130, and spring retainer contacts 124 electrically interconnected with the internal tube wiring 118. In the illustrated embodiment, the batteries 103 are electrically connected to power the lighted tree by the battery container upper electrical coupling including contact leads 111 and a lower battery terminal. In the illustrated embodiment, the batteries 103 are electrically connectable for recharging from an energy source external to the exemplary lighted tree through the recharging connector 123. In the depicted embodiment, the battery container assembly 101 is configured with the lower end cap 110 snap-in spring retainer contact 124 to retain the contact springs 115 to the end caps 110 and to contact the battery tube contact strip 242 (not shown). In the depicted embodiment, the lower end cap snap in spring retainer contact 124 is also in electrical connectivity with the lower contact spring 115. In the illustrated embodiment, the lower contact spring 115 is in electrical connectivity with the battery 103 negative terminal. In the depicted embodiment, the battery upper terminal is in electrical connectivity with the upper end cap 110 contact spring 115 (not illustrated) that contacts the upper spring retainer contact 124 (not illustrated). In some embodiments, the battery container assembly 101 may be configured with two end caps 110, including, for example, an upper end cap 110 and a lower end cap 110, configured in the battery container assembly 101. In various embodiments, the battery container assembly 101 may be configured with one end cap 110, which may be, for example, an upper end cap 110, or a lower end cap 110, configured in the battery container assembly 101. In the illustrated embodiment, the end cap 110 is operably coupled in electrical connectivity with the control module 108 adapted to control the light source. Other methods of retaining the batteries in the battery housing assembly are also within the scope of various embodiments of the present invention. In the depicted embodiment, the control module 108 includes a timer and switch configured to operably control the LED 106 and LED light string 126 illumination patterns. In the illustrated embodiment, the control module 108 output power is operably coupled from the control module 108 to the branch LEDs 106 and LED light string 126. In some embodiments, the trunk tube 139 may secure an LED 106 within an LED light reflector 109. In the illustrated embodiment, the LED light strings 126 include LEDs 106 configured to emit light from lighted tree branches 105. In the depicted embodiment, tree trunk tube 139 internal wiring 118 contact leads 111 exit the tube 139 and are coupled with connectors 137 configured to electrically connect the LED light strings 126. In the depicted embodiment, the Wi-Fi transmitter module 116 is adapted to operably configure the LED 106 and LED light string 126 illumination patterns governed by the control module 108. The illustrated embodiment lighted tree includes multiple trunk tube 139 sections mechanically and electrically coupled through the trunk tube 139 connector 136. In some embodiments, one or more trunk tube sections 139 operably coupled in an exemplary lighted tree may each retain a battery container assembly 101 operably coupled with one or more battery container assembly 101 in each of additional trunk tube sections 139.

Figure 2:
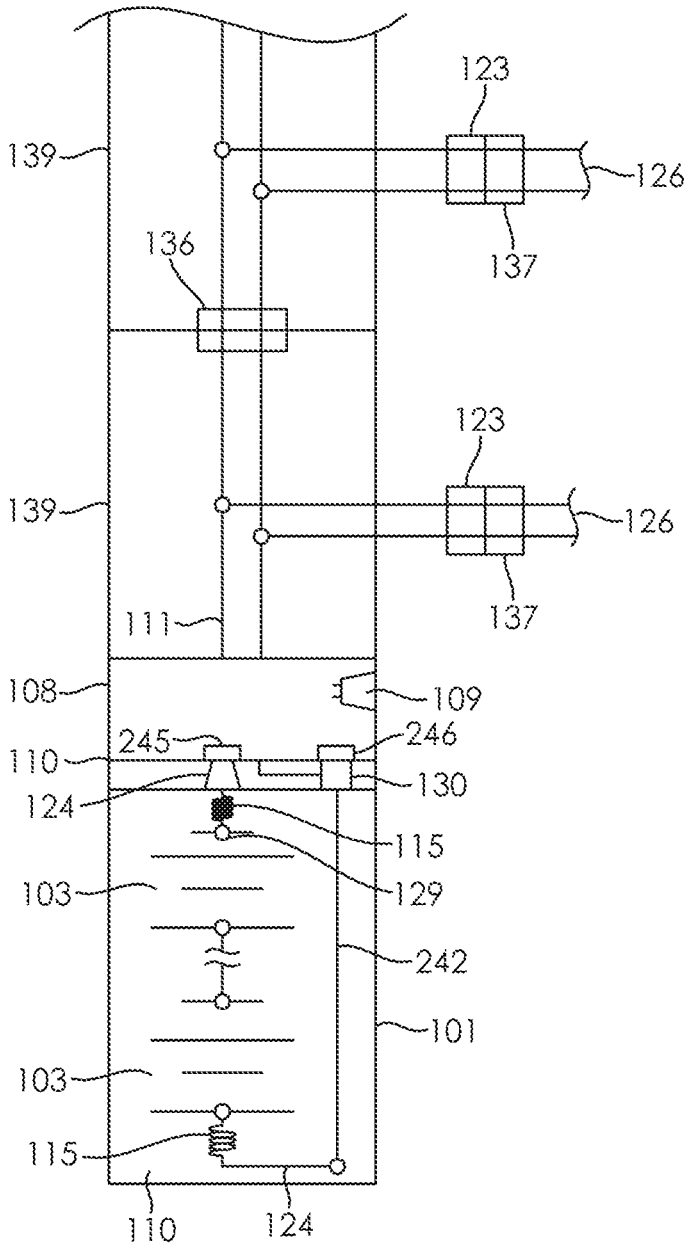
FIG. 2 depicts a circuit diagram illustrative of the exemplary lighted tree depicted in FIG. 1.

FIG. 2 depicts a circuit diagram illustrative of the exemplary lighted tree depicted in FIG. 1. In the embodiment depicted in FIG. 2, the battery 103 negative terminal is engaged in electrical and mechanical connectivity with the lower contact spring 115. In the depicted embodiment, the metal surface of the battery compartment contact strip 242 is engaged in electrical and mechanical connectivity with the end cap 110 spring retainer contact 124 configured in the bottom end cap 110. In the illustrated embodiment, the battery compartment contact strip 242 is also engaged in electrical and mechanical connectivity with the upper end cap 110 battery holder contact 130. In the depicted embodiment, the battery 103 positive terminal 129 is engaged in electrical and mechanical connectivity with the upper end cap 110 contact spring 115 and end cap spring retainer contact 124. In the illustrated embodiment, the upper end cap 110 end cap spring retainer contact 124 is operably coupled with the control module 108 positive contact 245 while the top end cap 110 battery holder contact is operably coupled with the control module 108 negative contact 246. In the depicted embodiment, the control module 108 includes a timer and switch operably coupled with the tree trunk tube 139 internal wiring 111. In the illustrated embodiment, the tree trunk tube 139 internal wiring 111 exits the tree trunk tube 139 and connects to the decorative LED light strings 126 via light string connectors 137. In the depicted embodiment, the tree trunk tube 139 internal wiring 111 also connects internally to the tube section connector 136. In the illustrated embodiment, the tube section connector 136 electrically and mechanically couples the tube 139 to the next tree trunk section tube 139 in various lighted tree embodiments including multiple interconnected tree trunk section tubes 139. In the illustrated embodiment, the tree trunk tube 139 internal wiring 111 also provides internal connections to operably couple additional tree trunk section tubes 139 via the battery housing spring retainer contact 124 and battery holder container return contact 130 in accordance with various embodiments including multiple interconnected tree trunk section tubes 139.

Figure 3:
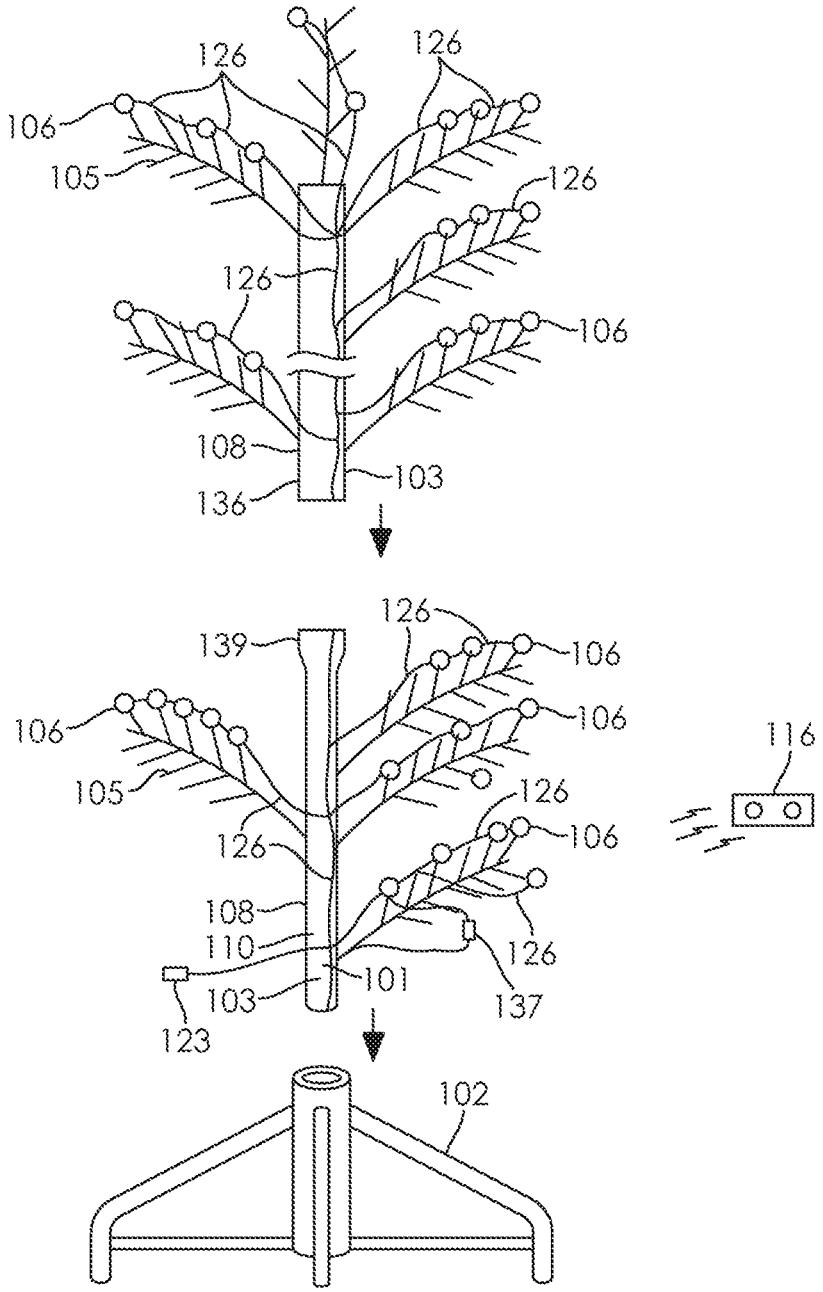
FIG. 3 depicts an exemplary alternative lighted artificial tree configured with embodiment tree trunk sections retaining rechargeable batteries.

FIG. 3 depicts an exemplary alternative lighted artificial tree configured with embodiment tree trunk sections retaining rechargeable batteries. In FIG. 3, the depicted embodiment lighted tree includes the battery container assembly 101 configured in a lower tree trunk section 139 to retain batteries to power the lighted tree. In the depicted embodiment, the lower tree trunk section 139 is illustrated in an assembly mode directed to configure a lighted tree assembly including the base 102 mechanically supporting electrically and mechanically interconnected upper and lower tree trunk sections 139. In the illustrated embodiment, the lighted tree includes the control module 108 operably coupled with the batteries 103 to control lighted tree light source illumination patterns or sequences. In the illustrated embodiment the control module 108 is configured to receive commands from the Wi-Fi transmitter module 116, which is adapted to operably configure the LED 106 and LED light string 126 illumination patterns governed by the control module. In the depicted embodiment, the control module 108 is operably coupled with a sensor and the recharger connector 123 configured in each tree trunk section. In the illustrated embodiment, a remote control is configured to send control signals via the Wi-Fi transmitter module 116. In the depicted embodiment, the Wi-Fi transmitter module 116 is operably coupled with the control module to link the control signals received from the remote control to the tree sections 139. In the illustrated embodiment, internal power leads connect the control signals to a tree trunk section connector and exit the tree trunk section 139 to connect with the LED light strings 126 that include LEDs 106 on the branches of the tree 105. In the depicted embodiment, recharging power may be supplied by an AC/DC hi to low voltage adapter connected to a charging power supply connected to the recharging connector 123.

Figure 4:
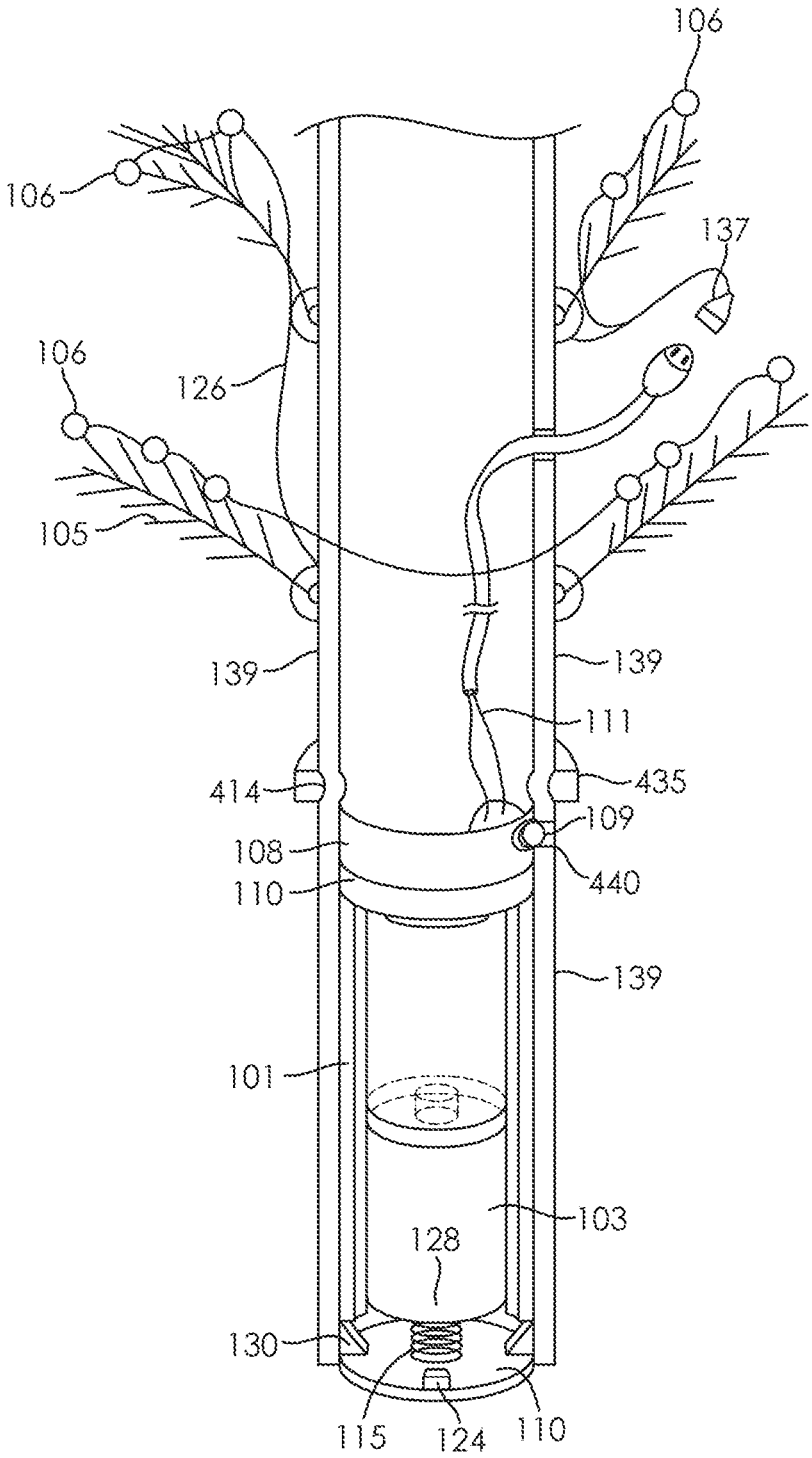
FIG. 4 depicts a side cross-sectional view of an exemplary tree trunk tube section.

FIG. 4 depicts a side cross-sectional view of an exemplary tree trunk tube section. In the embodiment depicted by FIG. 4, the lower part of the tree trunk tube 139 houses the battery container assembly 101 configured to retain the battery 103. In the illustrated embodiment, the battery container assembly 101 negative terminal is engaged in electrical and mechanical connectivity with the battery container assembly 101 spring retainer contact 124. In the depicted embodiment, the battery container assembly 101 contact spring 115 is engaged in electrical and mechanical connectivity with and retained by the battery container assembly 101 end cap 110 spring retainer contact 124. In the illustrated embodiment, the battery container assembly 101 end cap spring retainer contact 124 is part of the battery container assembly 101 lower end cap 110. In the depicted embodiment, the battery container assembly 101 end cap spring retainer contact 124 is engaged in electrical and mechanical connectivity with the battery compartment contact strip 242, depicted in FIG. 2. The battery compartment contact strip 242 is configured to run up the side wall of the illustrated battery compartment tube wherein the battery container assembly 101 upper end cap connector operably couples with the control module 108 via control module contacts. In the depicted embodiment, the negative terminal 128 of the battery container assembly 101 is engaged in electrical and mechanical connectivity with the battery container assembly 101 upper end cap spring retainer contact. In the depicted embodiment, the securing notch 414 mechanically engages the upper tree tube section 139 with the lower tree tube section 139. In the illustrated embodiment, the tree tube stop 435 prevents the upper tree tube section 139 from sliding too far into the lower tree tube section 139. In the illustrated embodiment, the battery container assembly 101 end cap 110 spring retainer contact 124 is engaged in electrical and mechanical connectivity with the control module 108. In the depicted embodiment, the control module 108 includes a Wi-Fi/Rf receiver module configured with a sensor adapted to view through the tree tube 139 via the window aperture 440 configured in the tree tube 139. In the depicted embodiment, the Wi-Fi/Rf control module output power is operably coupled with the tree tube 139 internal tube wiring 118 including contact leads 111. In the illustrated embodiment, the tree tube 139 internal tube wiring 118 also connects to additional wiring internal to the tree tube 139, exits the tree trunk 139, and connects via connectors to the LED lighting strings 126 which include LEDs 106 configured in lighted tree branches 105.

Figure 5:
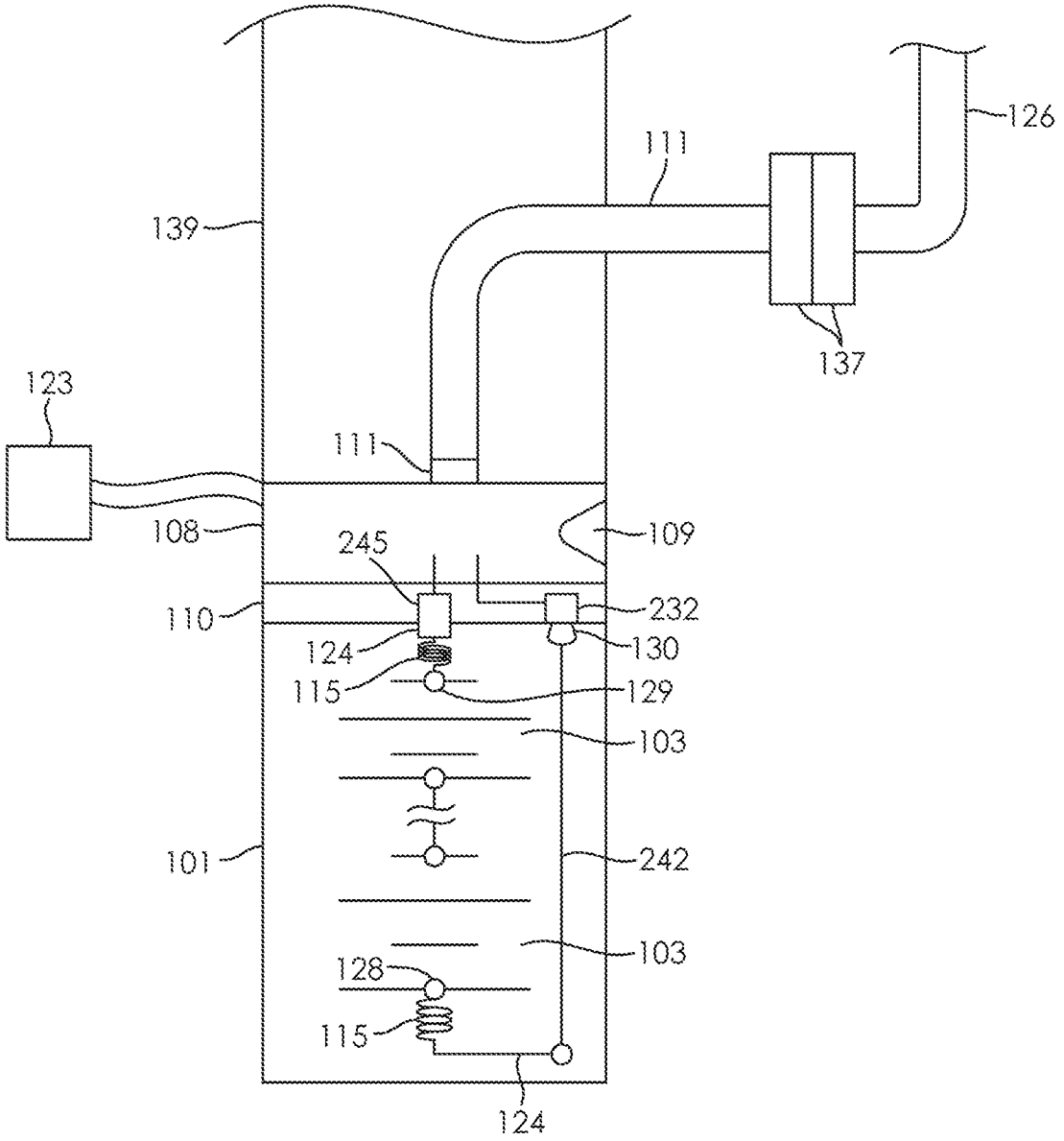
FIG. 5 depicts a circuit diagram illustrative of the exemplary lighted tree depicted in FIG. 4.

FIG. 5 depicts a circuit diagram illustrative of the exemplary lighted tree depicted in FIG. 4. In the embodiment depicted by FIG. 5, the battery container assembly 101 is configured to retain the battery 103 negative terminal 128 engaged in electrical and mechanical connectivity with the battery container assembly 101 lower contact spring 115. In the illustrated embodiment, the battery container assembly 101 lower contact spring 115 is engaged in electrical and mechanical connectivity with the battery container assembly 101 end cap 110 spring retainer contact 124. In the depicted embodiment, the battery container assembly 101 end cap 110 spring retainer contact 124 is engaged in electrical and mechanical connectivity with the metal surface of the battery holder contact strip 242, depicted in FIG. 2. The battery container assembly 101 battery holder contact strip 242 is engaged in electrical and mechanical connectivity with the battery container assembly 101 end cap 110 battery holder contact 130 and the end cap connector 232. In the depicted embodiment, the battery container assembly 101 is configured to engage the battery 103 positive terminal 129 retained within the battery container assembly 101 in electrical and mechanical connectivity with the battery container assembly 101 end cap 110 spring contact 115. In the illustrated embodiment, the battery container assembly 101 end cap 110 spring retainer contact 124 is engaged in electrical and mechanical connectivity with the battery container assembly 101 end cap 110 spring retainer contact 124 included in the battery container assembly 101 upper end cap 110. In the depicted embodiment, the battery container assembly 101 upper end cap 110 is engaged in electrical and mechanical connectivity with the Wi-Fi/RF control module 108. In the illustrated embodiment, the Wi-Fi/RF control module includes a Wi-Fi/RF receiver. In the depicted embodiment, the Wi-Fi/RF control module is electrically and operably coupled with the recharging connector 123. In the illustrated embodiment, the internal trunk tube wiring 118 exits the tube 139 to electrically to and operably power the decorative LED light strings 126 via the connectors 137.

Figure 6:
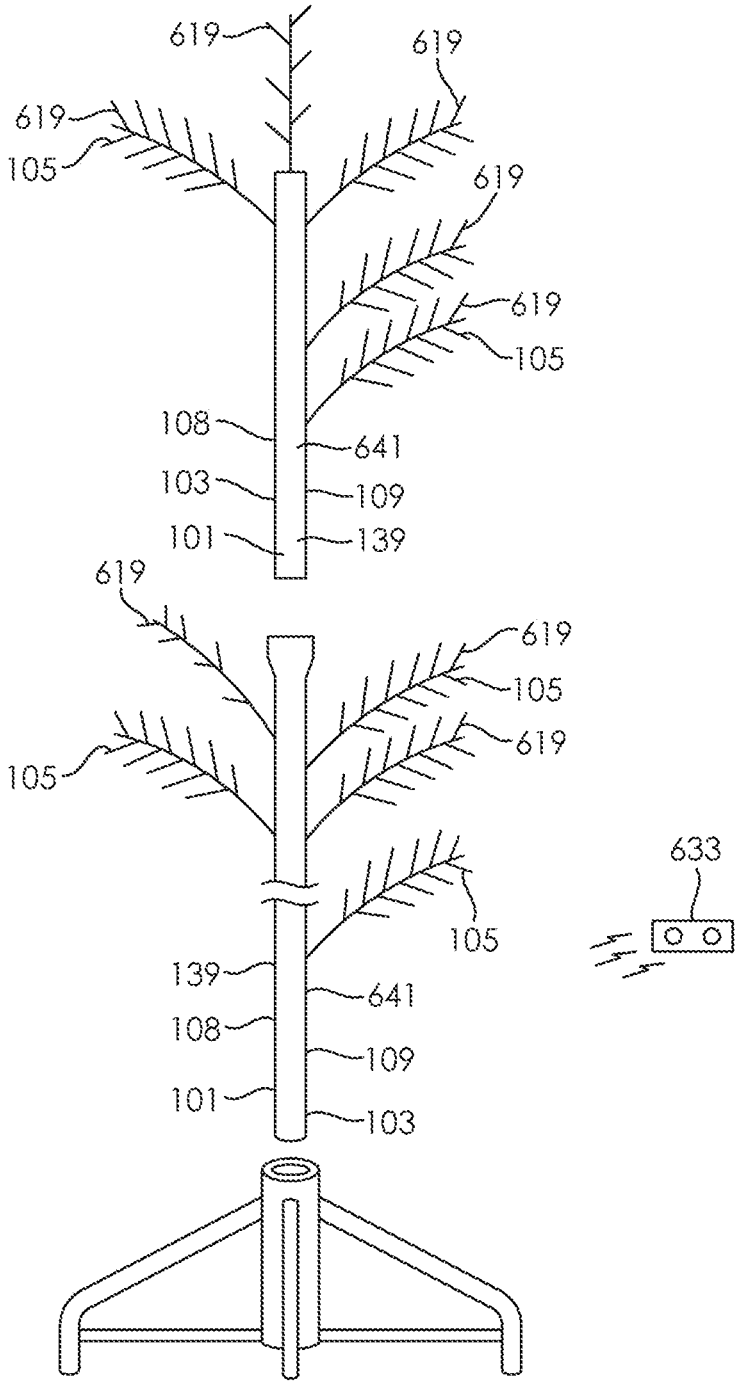
FIG. 6 depicts an exemplary alternative lighted artificial tree configured with embodiment tree trunk sections retaining rechargeable batteries.

FIG. 6 depicts an exemplary alternative lighted artificial tree configured with embodiment tree trunk sections retaining rechargeable batteries. In the embodiment depicted by FIG. 6, each tree trunk section 139 is configured with a battery container assembly 101 retaining batteries 103. In the illustrated embodiment, each tree trunk section 139 includes a control module 108 configured with a sensor adapted to view through the tree tube 139 via a window aperture configured in the tree tube 139. In the depicted embodiment, each tree trunk section 139 is configured with a recharging connector electrically and operably coupled with the tree trunk section 139 internal trunk tube wiring to charge the battery from an external energy source coupled to the recharging connector. In the depicted embodiment, the control sections are configured in each tree trunk section 139. In the illustrated embodiment, the control units' control signals are transmitted to the tree trunk sections 139 by the remote-control unit 633. In the depicted embodiment, the tree trunk sections 139 internal tube wiring electrically connects to power the LED 106 configured to emit light reflected by the LED light reflector 109 from the tree trunk section 139. In the illustrated embodiment, the optical fibers 619 are operably and optically coupled with at least one LED 106 to emit light reflected from the LED light reflector 109 governed by the control section and remote control 633. In the depicted embodiment, the tree trunk sections 139 internal wiring exits the tree trunk section 139 and extends to the branches of the tree 105. In some embodiments, the tree trunk section 139 internal wiring is engaged in electrical and mechanical connectivity with a tree trunk section connector 136, as depicted, for example, at least in FIG. 1 and FIG. 2. In various embodiments, the tree trunk section connector 136 may be engaged in electrical and mechanical connectivity with the next tree trunk section 139 internal wiring and the location keying strip 641. In some embodiments, the next tree trunk section 139 internal wiring may electrically and operably couple the next tree trunk section 139 including LED 106 and LED reflector 109 with Optical fibers 619 configured above the next tree trunk section 139 LED reflector 109. In various embodiments, the tree trunk sections 139 LEDs 106 and LED reflectors 109 may emit light directed into the optical fibers 619. In the depicted embodiment, the optical fibers 619 are configured in each trunk section 139 to exit the tree trunk section 139 to emit light from the tree branches 105. In the illustrated embodiment, recharging power is supplied by an AC/DC hi to low voltage adapter connected to a charging power supply connected to the recharging connector 123, depicted in FIG. 1.

Figure 7:
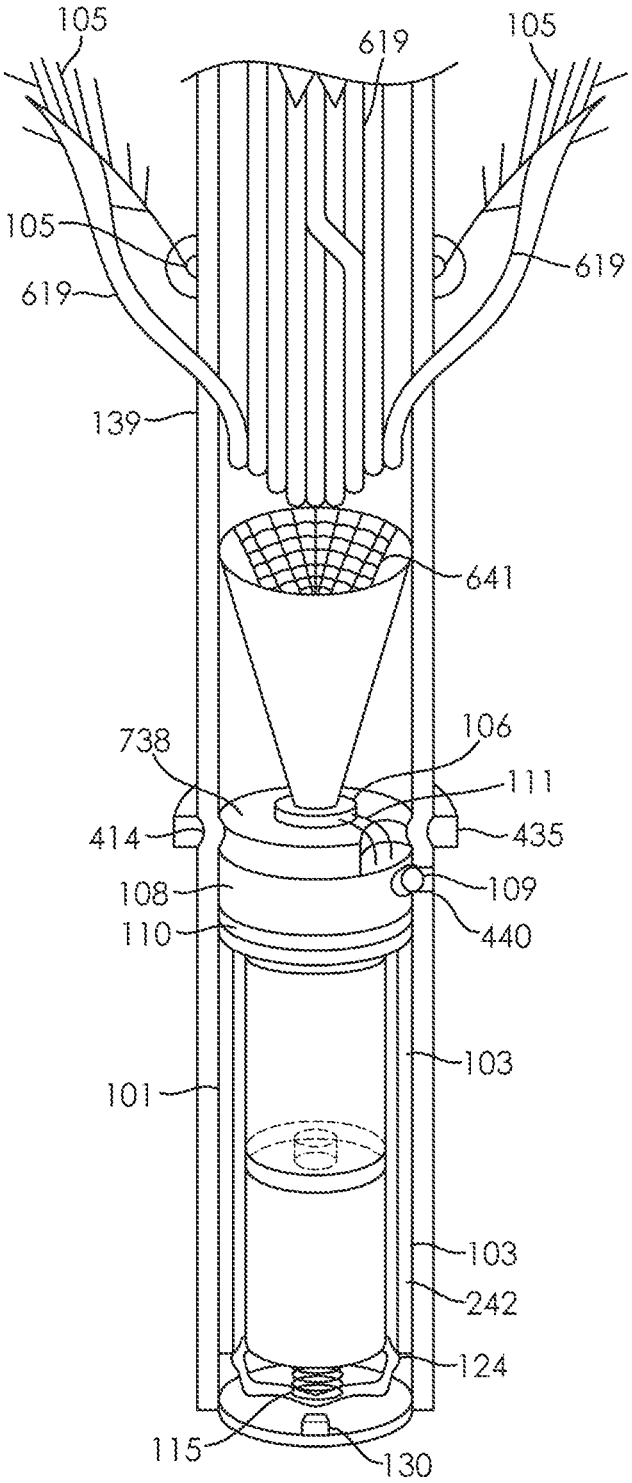
FIG. 7 depicts a side cross-sectional view of an exemplary tree trunk tube section.

FIG. 7 depicts a side cross-sectional view of an exemplary tree trunk tube section. In the embodiment depicted by FIG. 7, the lower part of the tree trunk tube 139 houses the batteries 103 retained within the battery container assembly 101 operably configured to power the lighted tree with the batteries 103. In the illustrated embodiment, the battery 103 negative terminal is engaged in electrical and mechanical connectivity with the battery container assembly 101 contact spring 115. In the depicted embodiment, the battery container assembly 101 contact spring 115 is electrically connected with the battery container assembly 101 end cap spring retainer contact 124. In the illustrated embodiment, the battery container assembly 101 end cap spring retainer contact 124 is part of the battery container assembly 101 lower end cap. In the depicted embodiment, the battery container assembly 101 end cap spring retainer contact 124 is engaged in electrical and mechanical connectivity with the battery container assembly 101 contact strip 242. In the illustrated embodiment, the battery container assembly 101 contact strip 242 is configured to runs up the side wall of the battery compartment tube. In the depicted embodiment, the battery container assembly 101 upper end cap 110 connector is electrically and operably coupled with the control module 108 included in the lighted tree, operably coupled with the lighted tree light sources, and configured to govern the tree light source illumination patterns. In the depicted embodiment, the battery 103 positive terminal 129 is engaged in electrical and mechanical connectivity with the battery container assembly 101 upper end cap 110 contact spring and the battery container assembly 101 end cap 110 retainer contact. In the illustrated embodiment, the battery container assembly 101 end cap 110 retainer contact is engaged in electrical and mechanical connectivity with the control module 108. In the depicted embodiment, the control module 108 includes a Wi-Fi/Rf receiver module configured with a sensor adapted to view through the tree tube 139 via a window aperture 440. In the illustrated embodiment, the control module includes a recharging connector configured to operably charge the battery 103 or power the control module 108 from an energy source external to the tree. In the depicted embodiment, the Wi Fi/Rf control module 108 is operably coupled with the tree trunk section 139 internal wiring including contact leads 111. In the illustrated embodiment, the tree trunk section 139 internal wiring including contact leads 111 is engaged in electrical and mechanical connectivity with the LED 106 configured with heat sink 738 to emit light into reflector 641 and illuminate the optical fibers 619 that exit the tree trunk tube 139 and are configured in the tree branches 105.

Figure 8:
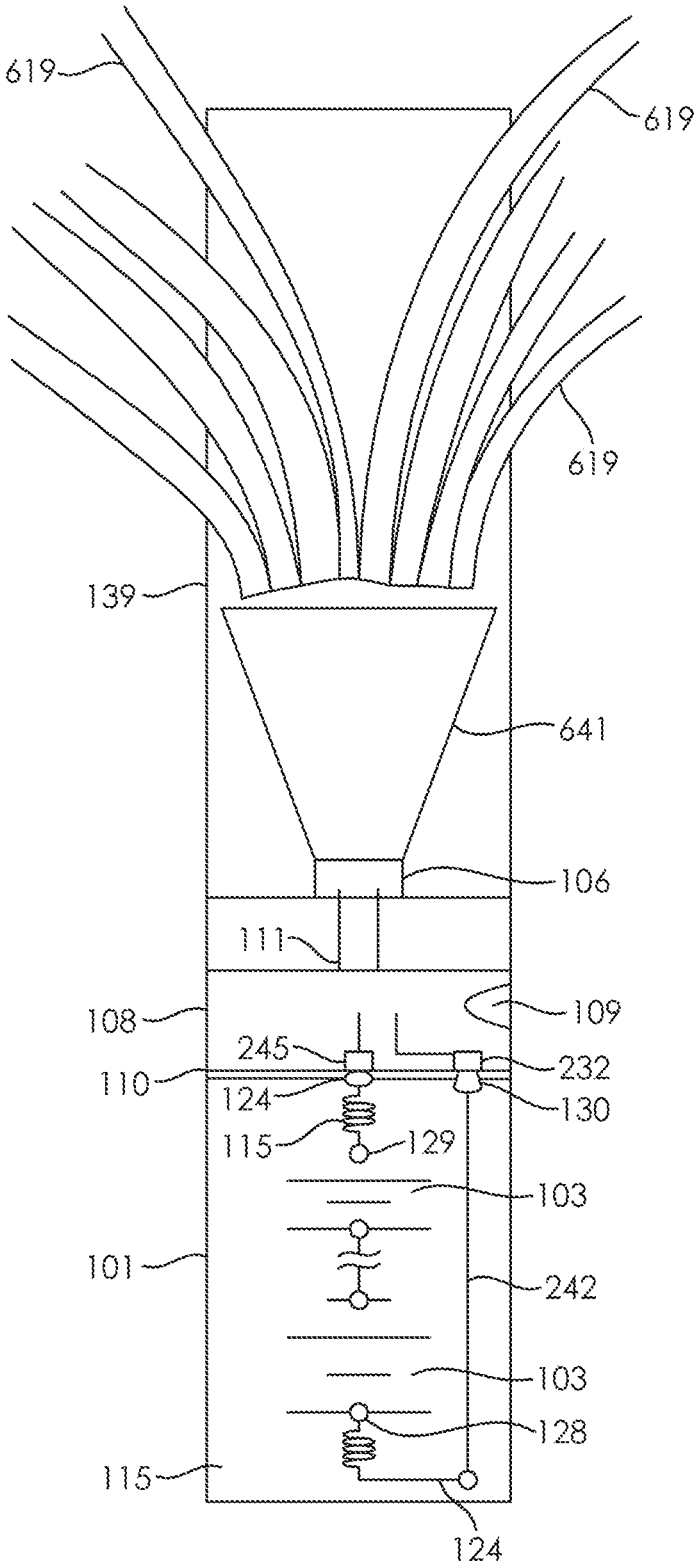
FIG. 8 depicts a circuit diagram illustrative of the exemplary lighted tree and trunk sections depicted in FIG. 6 and FIG. 7.

FIG. 8 depicts a circuit diagram illustrative of the exemplary lighted tree and trunk sections depicted in FIG. 6 and FIG. 7. In the embodiment depicted by FIG. 8, the battery 103 negative terminal 128 is engaged in electrical and mechanical connectivity with the battery container assembly 101 lower contact spring 115. In the illustrated embodiment, the battery container assembly 101 lower contact spring 115 is engaged in electrical and mechanical connectivity with the battery container assembly 101 end cap spring retainer contact 124. In the depicted embodiment, the battery container assembly 101 end cap spring retainer contact 124 is engaged in electrical and mechanical connectivity with the metal surface of the battery holder contact strip 242. In the illustrated embodiment, the battery container assembly 101 contact strip 242 is engaged in electrical and mechanical connectivity with the battery container assembly 101 end cap 110 connector 232. In the depicted embodiment, the battery 103 positive terminal 129 is engaged in electrical and mechanical connectivity with the battery container assembly 101 end cap contact spring 115. In the illustrated embodiment, the battery container assembly 101 end cap contact spring 115 is engaged in electrical and mechanical connectivity with the battery container assembly 101 end cap 110 spring retainer contact 124 included in the battery container assembly 101 upper end cap 110. In the depicted embodiment, the battery container assembly 101 upper end cap 110 is engaged in electrical and mechanical connectivity with the Wi-Fi/RF control module 108 positive contact 245. In the illustrated embodiment, the Wi-Fi/RF control module 108 is configured with a Wi-Fi/RF receiver and recharging connector. In the illustrated embodiment, the Wi-Fi/RF control module 108 is electrically and operably coupled with the LED 106 through the tree trunk tube section 139 internal tube wiring including contact leads 111. In the depicted embodiment, the control module 108 is configured to control the LED 106 emitted light directed into the LED reflector 641. In the illustrated embodiment, the LED 106 light directed into the LED reflector 641 illuminates the optical fibers 619 configured to exit the tree trunk tube section 139 via various apertures disposed in the lighted tree branches.

Figure 9:
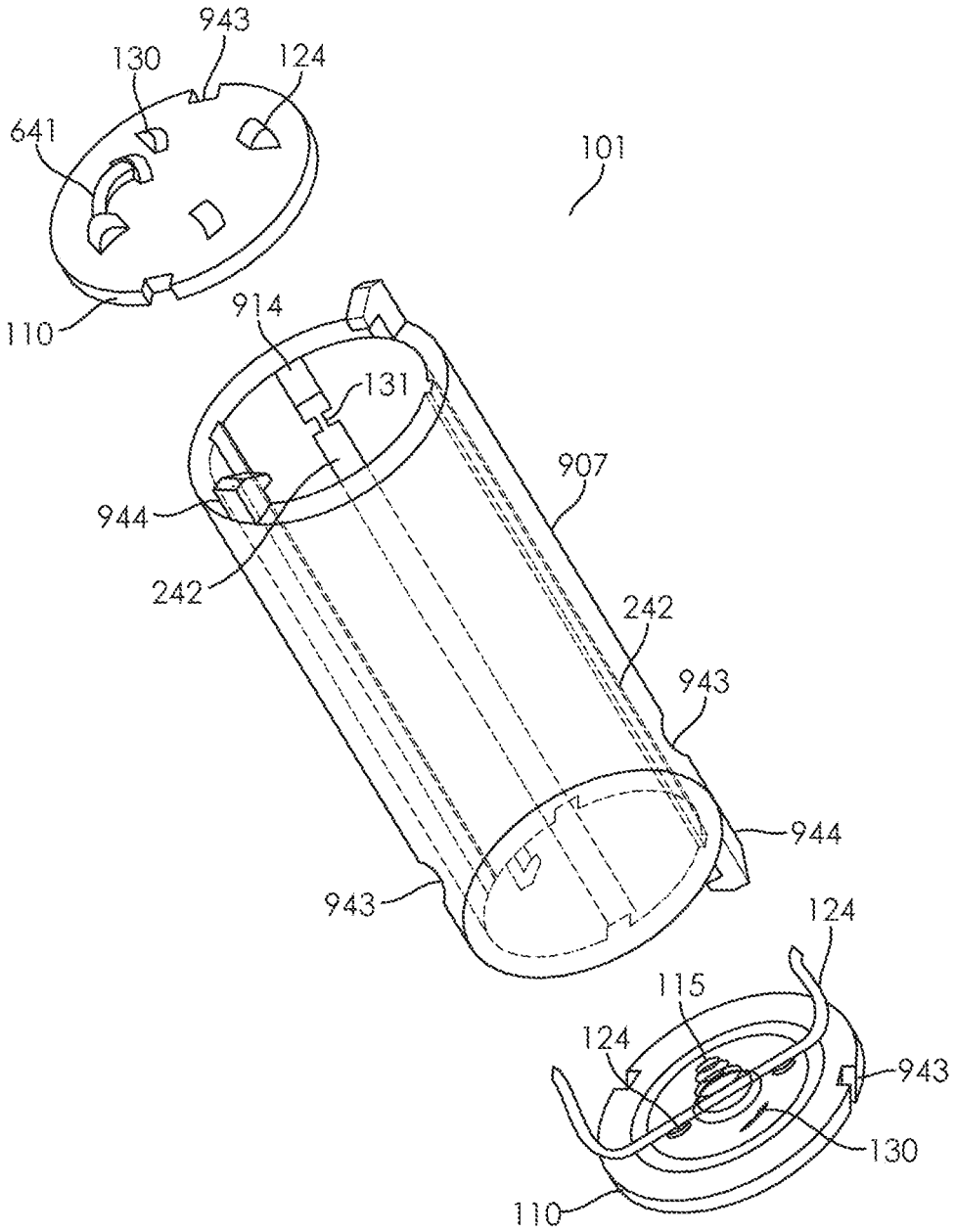
FIG. 9 depicts a side perspective exploded view of exemplary battery container assemblies.

FIG. 9 depicts a side perspective exploded view of exemplary battery container assemblies. In the embodiment depicted by FIG. 9, the depicted battery container assemblies 101 include non-conductive tubes configured with upper and lower end caps 110. In the illustrated embodiment, the upper and lower end caps 110 configured in the battery assembly container 101 non-conductive tubes include four contacts 124 and 130 configured in each end cap 110. In the depicted embodiment, the upper and lower end caps 110 included in the battery container assembly 101 non-conductive tubes include two end cap spring retainer contacts 124 in each end cap adapted to retain and electrically connect to battery container assembly 101 end cap 110 contact springs 115. In the illustrated embodiment, the end cap 110 spring retainer contacts 124 configured in each end cap 110 are engaged in electrical and mechanical connectivity with two battery container assembly 101 end cap connectors configured near the battery container assembly 101 side wall compartment contact strips 242. In the depicted embodiment, the battery container assembly 101 side wall compartment contact strips 242 are mechanically secured by the battery container assembly 101 contact strip retainer protrusions 131 in the battery container assembly 101 contact strip grooves 914, allowing the opposite battery container assembly 101 end cap 110 contacts to rotate while the end caps 110 are held in place to the battery compartment tubes by the battery tube snap retainers 944 that are part of the battery tube. In the illustrated embodiment, the two battery compartments 101 are in electrical contact with each other in the tree pole tube 139 and are located to make electrical contact by the locator keying strip 943 configured on the end caps 110 that prevent electrical connection unless they are substantially lined up at 0, 90, 180, or 270 degrees to each other.

Figure 10:
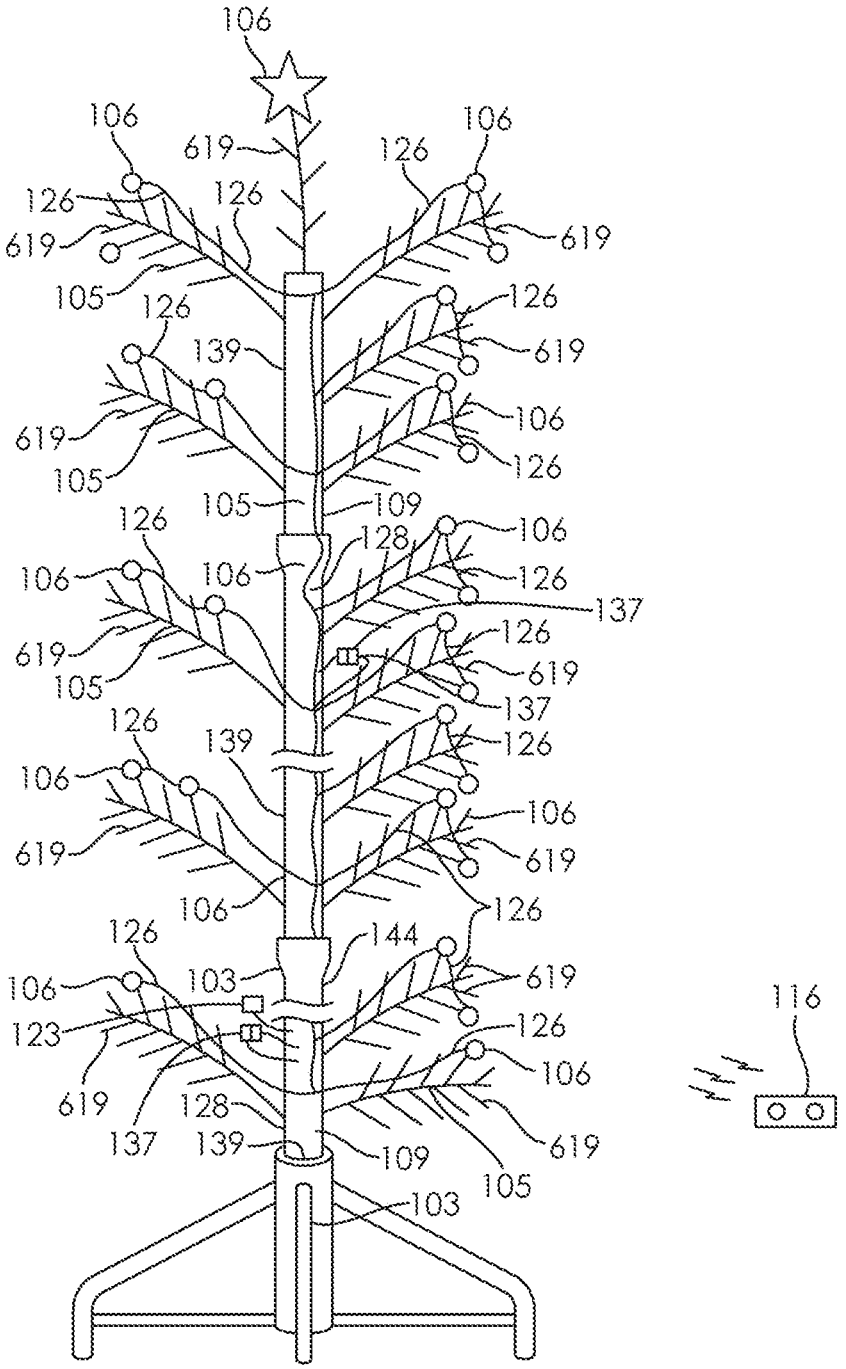
FIG. 10 depicts an exemplary alternative lighted artificial tree configured with embodiment tree trunk sections retaining rechargeable batteries.

FIG. 10 depicts an exemplary alternative lighted artificial tree configured with embodiment tree trunk sections retaining rechargeable batteries. In the embodiment depicted by FIG. 10, the exemplary battery-powered artificial tree includes batteries 103 operably housed within the tree trunk sections 139 to power the artificial tree. In the depicted embodiment, the batteries 103 are illustrated in phantom. In the illustrated embodiment, the batteries 103 are configured to power the illumination of either individual LEDs 106 arranged on LED light strings 126, and/or, to power the optical fibers 619 from one or more LEDs 106 configured with LED reflectors 641. In the depicted embodiment, the LED reflectors 641 are illustrated in phantom. In the illustrated embodiment, the LEDs 106 arranged on LED light strings 126, and the LEDs 106 configured with LED reflectors 641, are configured within the tree trunk section tubes 139 for operable control by a remote-control unit and sensors. In the depicted embodiment, the Wi-Fi/RF transmitter module 116 is configured to control the artificial tree illumination by transmitted remote-control unit signals operably coupled with sensors configured in the tree trunk sections 139. In the illustrated embodiment, the battery 103 is configured with capability to recharge from an energy source external to the tree connectable to a recharging connector coupled with the battery 103.

Figure 11:
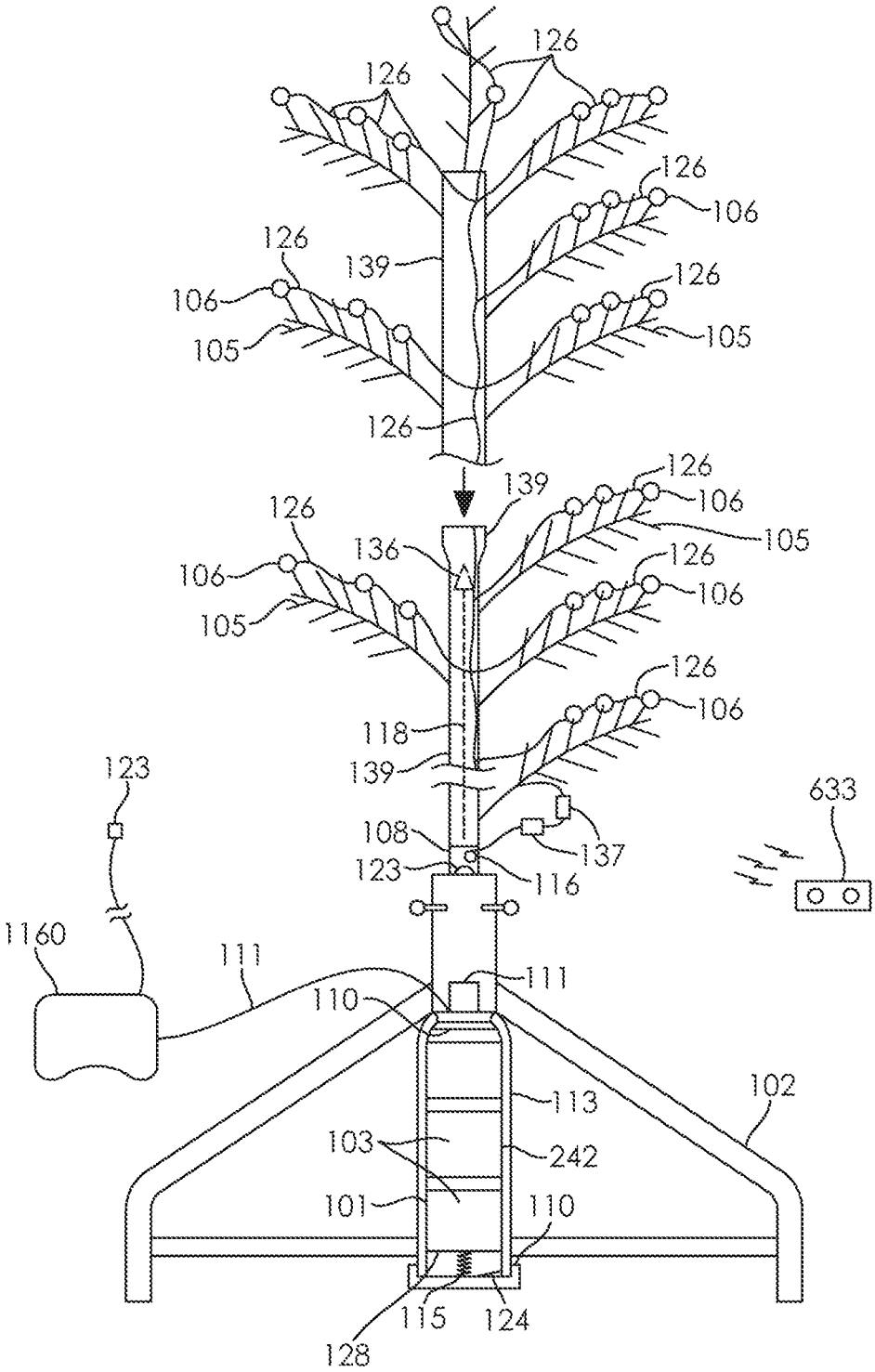
FIG. 11 depicts an exemplary alternative lighted artificial tree configured with embodiment tree trunk sections retaining rechargeable batteries.

FIG. 11 depicts an exemplary alternative lighted artificial tree configured with embodiment tree trunk sections retaining rechargeable batteries. In the embodiment depicted by FIG. 11, the batteries 103 are operably housed in the battery container assembly 101 retained within the tree stand tube 113 supported by the tree stand 102. In the illustrated embodiment, the battery container assembly 101 includes the bottom end cap 110 configured with the lower snap in spring retainer contact 124 engaged in electrical and mechanical connectivity with the battery container assembly 101 metal contact strip 242. In the depicted embodiment, the bottom end cap 110 lower snap in spring retainer contact 124 is also engaged in electrical and mechanical connectivity with the lower contact spring 115. In the illustrated embodiment, the lower contact spring 115 is engaged in electrical and mechanical connectivity with the battery 103 negative terminal 128. In the depicted embodiment, the battery 103 upper terminal is engaged in electrical and mechanical connectivity with the end cap 110 center terminal. In the illustrated embodiment, the end cap center terminal is engaged in electrical and mechanical connectivity with the control module 108 configured with a timer and switch. In the depicted embodiment, the control module 108 output power is operably coupled to the connectors 137. In the illustrated embodiment, the connectors 137 are operably coupled with tree LED light strings 126 including LEDs 106 arranged on the tree branches 105. In the depicted embodiment, the control module 108 is operably coupled with and configured to govern the LED light strings 126 illumination. In the illustrated embodiment, the control module 108 is operably coupled for remote control by the remote-control unit 633. In the depicted embodiment, the remote-control unit 633 signals are received by the Wi-Fi/RF receiver 116 housed in the control module 108. In the illustrated embodiment, the control module 108 is configured with the recharging connector 123. In the depicted embodiment, the recharging connector 123 is electrically and operably coupled with the solar charger 1160 configured to charge the battery 103.

Figure 12:
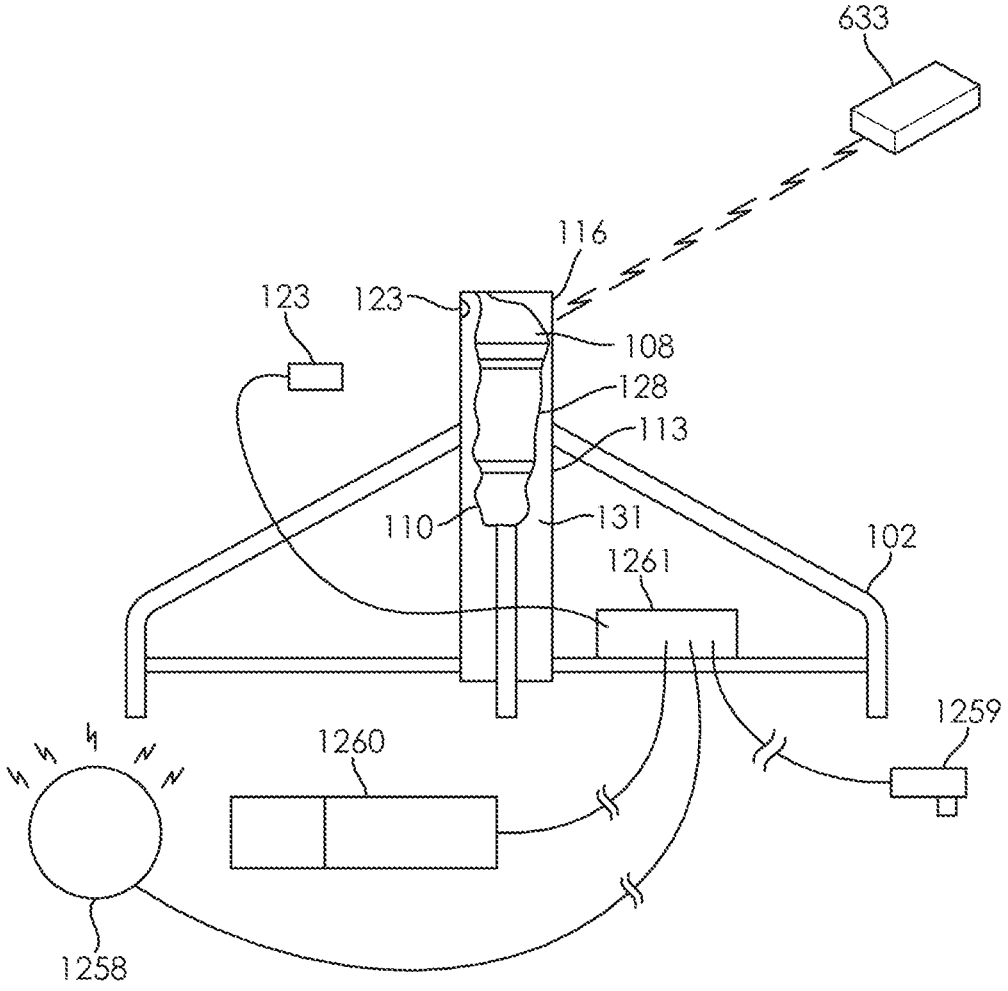
FIG. 12 depicts a side cross-sectional view of an exemplary tree stand.

FIG. 12 depicts a side cross-sectional view of an exemplary tree stand. In the embodiment depicted by FIG. 12, the exemplary tree stand 102 includes the batteries 103 operably engaged in electrical and mechanical connectivity with the end cap 110. In the illustrated embodiment, the end cap 110 is engaged in electrical and mechanical connectivity with the Wi-Fi/RF receiver module 108. In the depicted embodiment, the Wi-Fi/RF receiver module 108 includes the Wi-Fi/RF sensor 116 configured to receive a signal transmitted by the wireless remote-control unit 633. In the illustrated embodiment, the Wi-Fi/RF sensor 116 includes the first recharging connector 123 configured to electrically couple with the second recharging connector 123 connected with the recharging power supply 1261. In the depicted embodiment, the recharging power supply 1261 is configured to power one or more lighted tree trunk tube section 139, depicted, for example, in at least FIGS. 1, 2, 3, 4, 5, 6, 7, 8, 10, and 11, installed in the tree stand 102. In the illustrated embodiment, the recharging power supply 1261 is operably coupled with the solar charger 1260 to power the lighted tree with power received from the solar charger 1260. In the illustrated embodiment, the recharging power supply 1261 is operably coupled with the AC/DC Hi to Lo voltage adapter 1259 to power the lighted tree with power received from the AC/DC Hi to Lo voltage adapter 1259. In the illustrated embodiment, the recharging power supply 1261 is operably coupled with the multifrequency energy harvester sensor module 1258 to power the lighted tree with power received from the multifrequency energy harvester sensor module 1258.

Figure 13A:
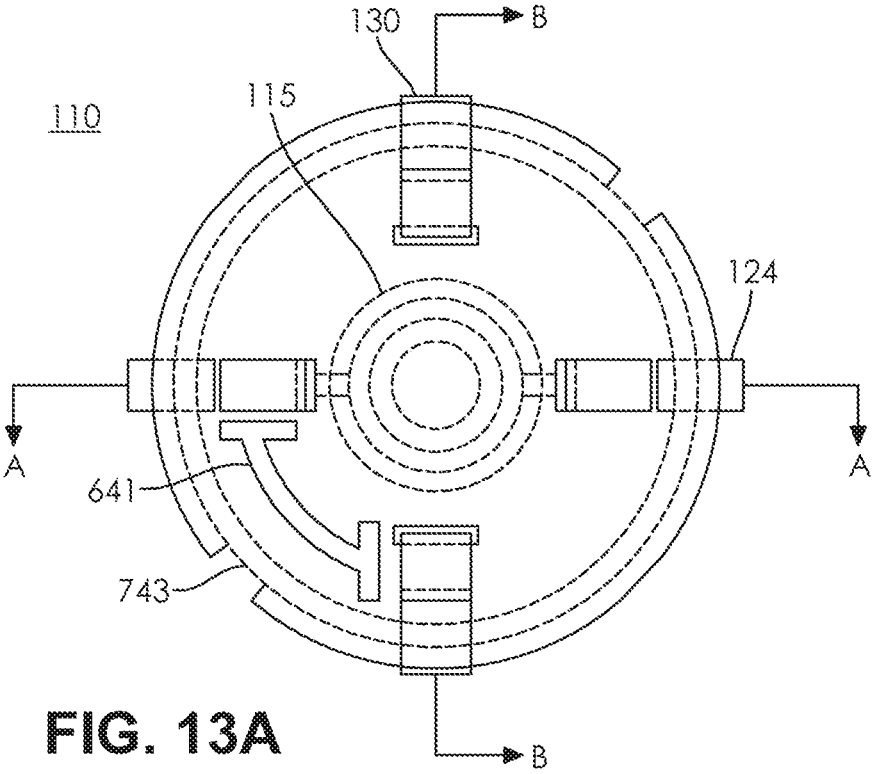
FIGS. 13A-13C depict illustrative top and side views of an exemplary battery holder end cap.
Figure 13B:
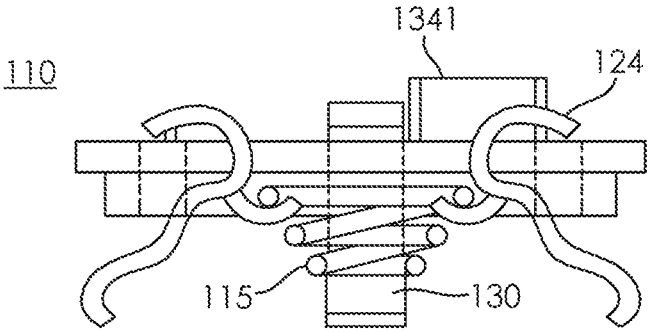
Figure 13C:
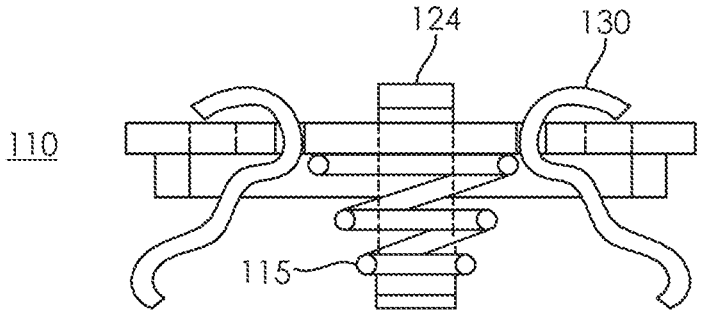

FIGS. 13A-13C depict illustrative top and side views of an exemplary battery holder end cap. FIG. 13A depicts an illustrative top view of an exemplary battery holder end cap 110. FIGS. 13B-13C depict illustrative side views of an exemplary battery container assembly 101 end cap 110. In the embodiment depicted by FIGS. 13A-13C, the non-conductive end cap 110 includes the spring contact 115 retained by the two spring retainer contacts 124. In the illustrated embodiment, the spring contact 115 is also retained by the two end cap connectors 130. In the depicted embodiment, the end cap 110 includes four end cap snap latch indentations 743 which are in an illustrative example depicted at substantially 45 degrees from the center lines of the spring retainer contacts 124. In the illustrated embodiment, the end cap 110 also includes the raised location keying strip 641 configured to prevent electrical contact unless the end cap 110 contacts are substantially lined up at 0, 90, 180, or 270 degrees to electrically and mechanically couple with another end cap 110.

FIG. 14 depicts a side perspective cross-sectional view of an exemplary battery compartment tube. In the embodiment depicted by FIG. 14, the exemplary battery compartment tube 1407 includes the battery tube top snap retainer 944. In the illustrated embodiment, the battery compartment tube 1407 also includes the battery tube contact strip 242 configured in the contact strip groove 914. In the depicted embodiment, the battery compartment tube 1407 is configured with the contact strip retainer protrusions 131. In various embodiments, exemplary battery compartment tube 1407 designs may be configured to operably retain batteries 103 in a tree trunk tube section 139 or tree stand 102 to power various embodiment lighted tree implementations.

FIG. 15 depicts a side cross-sectional view of an exemplary tree trunk section tube retaining an exemplary battery compartment tube. In the embodiment depicted by FIG. 15, the tree trunk tube section 139 retains the battery compartment tube 1407. In the illustrated embodiment, the battery compartment tube 1407 includes the end cap 110. In the depicted embodiment, the end cap 110 includes the end cap 110 end cap connectors 130. In the illustrated embodiment, the end cap 110 end cap connectors 130 are engaged in electrical and mechanical connectivity with the battery compartment tube 1407 contact strips 242, also depicted, for example, at least in FIG. 2. In the depicted embodiment, the battery compartment tube 1407 contact strips 242 are engaged in electrical and mechanical connectivity with the end cap 110 spring retainer contact 124 that contacts the control module 108 contacts 445. In the illustrated embodiment, the control module 108 contacts 445 and the spring retainer contact 124 are engaged in electrical and mechanical connectivity with the battery 103 positive terminal 129. In the depicted embodiment, the battery 103 and the battery 103 positive terminal 129 are engaged in electrical and mechanical connectivity with and retained by the end cap 110 spring retainer contact 124. In the illustrated embodiment, the end cap 110 spring retainer contact 124 is engaged in electrical and mechanical connectivity with the control module 108 contacts 445 center terminal. In the illustrated embodiment, the control module 108 includes a Wi/Fi/RF control module engaged in electrical and mechanical connectivity with the control module 108 contacts 445 center terminal. In the illustrated embodiment, the Wi/Fi/RF control module 108 includes the Wi-Fi/RF sensor 116 and the recharging connector 123 accessible through the window aperture 1556. In the depicted embodiment, Wi/Fi/RF control module 108 is configured with the recharging connector 123, as well as contact leads 111 operably coupled to power various LED light strings or LEDs configured to illuminate optical fibers.

FIGS. 16A-16D depict exemplary battery compartment connection combinations. FIGS. 16A-16D illustrate various exemplary battery container assembly 101 connection combination arrangement designs. In the embodiment depicted by FIG. 16A, two battery container assemblies 101 each retain two batteries 103 engaged in series electrical connectivity providing 3 volts output for each of the two battery container assemblies 101. In the illustrated embodiment, each of the two battery container assemblies 101 are also engaged in series electrical connectivity yielding a total output voltage of 6 volts for the two series-coupled battery container assemblies 101 depicted in FIG. 16A. In the depicted embodiment, the end cap 110 spring retainer contact 124 is engaged in electrical and mechanical connectivity with an end cap 110 spring contact 115, depicted, for example, at least in FIG. 8, FIG. 9, FIG. 11, and FIG. 13. In the illustrated embodiment, the end cap 110 spring retainer contact 124 and end cap 110 spring contact 115 are engaged in electrical and mechanical connectivity with the negative terminal 128 of the lower battery 103 in each battery container assembly 101. In the embodiment depicted by FIG. 16A, the lower battery 103 is in series with the upper battery 103. In the illustrated embodiment, the upper battery 103 positive terminal 129 is engaged in electrical and mechanical connectivity with the end cap 110 spring retainer contact 124. In the depicted embodiment, the end cap 110 spring contact 115 is engaged in electrical and mechanical connectivity with the end cap 110 spring retainer contact 124 configured at the top of the battery container assembly 101. In the depicted embodiment, the end cap spring retainer contact 124 configured at the bottom of each battery container assembly 101 is also engaged in electrical and mechanical connectivity with the battery container assembly 101 compartment contact strip 242 configured to run to the top of the battery container assembly 101. In the illustrated embodiment, the battery container assembly 101 compartment contact strip 242 is engaged in electrical and mechanical connectivity with the end cap 110 end cap connectors 130.

Figure 16A:
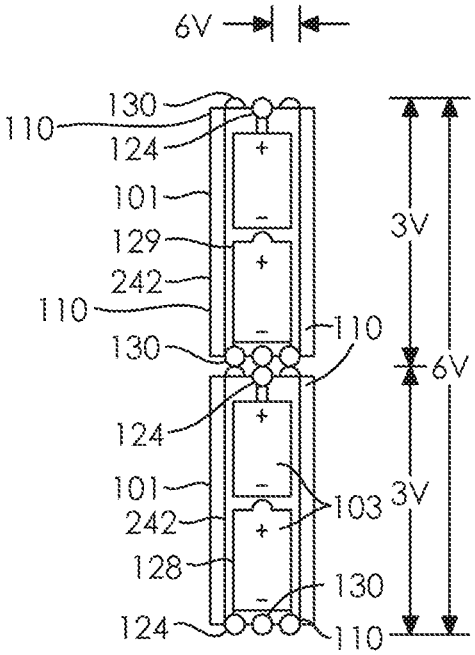
FIGS. 16A-16D depict exemplary battery compartment connection combinations.
Figure 16B:
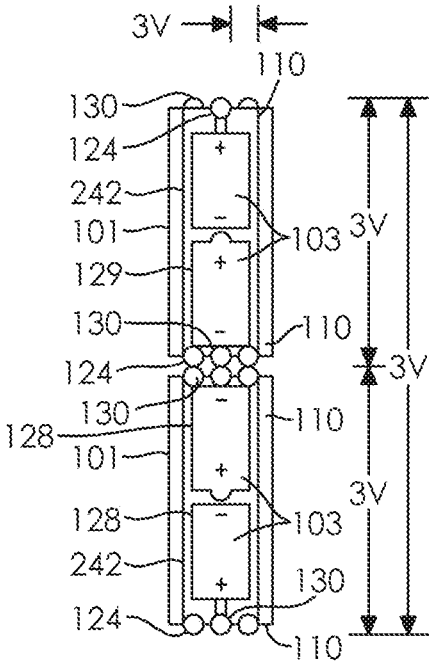

In the embodiment depicted by FIG. 16B, the lower battery container assembly 101 is oriented upside-down, connecting the negative terminals of the battery container assemblies 101 together, and electrically coupling the two battery container assemblies 101 in parallel.

Figure 16C:
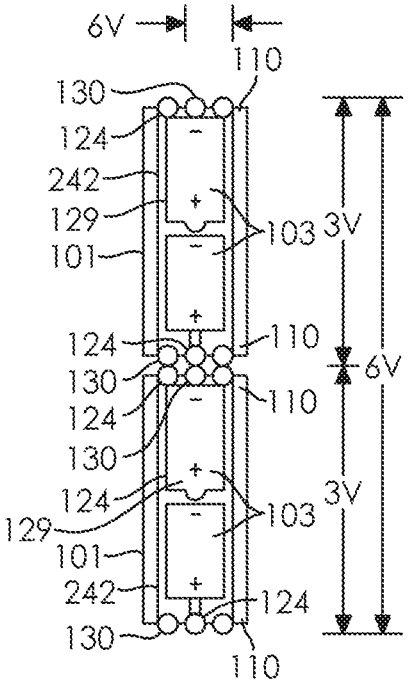

In the embodiment depicted by FIG. 16C, the batteries 103 in both battery container assemblies 101 are oriented upside-down, and the end cap 110 contacts, end cap connector 130, and end cap 110 spring retainer contact 124 are also reversed, allowing the top center contact to remain the positive terminal, the side contacts the negative terminal, and the battery compartments to be in series, also providing an output voltage of 6 volts. In the embodiment depicted by FIG. 16D, the batteries 103 are reversed as compared to the batteries 103 depicted in FIG. 16B, with the batteries 103 in FIG. 16D connected in parallel.

FIGS. 16A-16D describe a variety of voltage and polarity options, including, for example, the use of a common end cap 110 with the external contact points, spring retainer contact 124 (2) per end cap and battery holder contacts 130 (2) per end cap 110 are located substantially 90 degrees from one another as depicted in FIG. 13A and FIG. 9 on fixed radius from the center of the end cap 110. In some embodiments, the control module 108 contacts may in be configured in like manner at substantially 90 degree locations, for example, in the FIG. 16 A the batteries are shown with the positive terminal 129 pointed up, and would be placed in contact to the control module 108 to meet to match the input polarity of the module, where as the batteries in FIG. 16 C have their positive terminals 129 pointed downward, in order to have the battery holders 101 polarity of that of the control module the battery holders 101 only need to be rotated 90 degrees to have the polarity connect as desired.

Figure 16D:
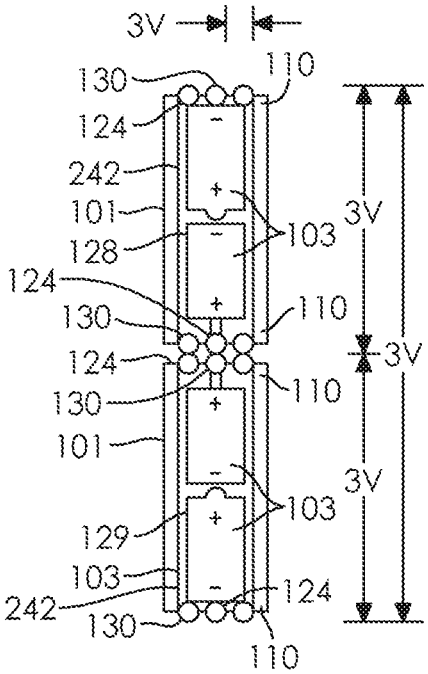

FIG. 16B and FIG. 16D further depict two battery holders 101 joined in such a way that the positive terminals 129 of the batteries 103 are facing each other, by rotating the battery holders 101 90 degrees to that of FIG. 16A or C, the contacts connect to put the battery holders 101 in parallel rather than in series.

Although various embodiments have been described with reference to the Figures, other embodiments are possible. For example, some designs may provide customizable illumination patterns using a programmable controller adapted to control the light source. In an illustrative example, some embodiment lighted artificial tree designs may include a rechargeable battery. In various embodiments, the battery may be electrically connected with one or more energy source external to the lighted artificial tree. In some exemplary implementations, the energy source external to the lighted artificial tree may include a photovoltaic collector configured to charge the battery or power the lighted artificial tree. In various illustrative embodiment designs, the energy source external to the lighted artificial tree may include a multifrequency energy harvesting module configured to harvest ambient energy. For example, the multifrequency energy harvesting module may be configured to harvest ambient light. In some embodiments, the multifrequency energy harvesting module may be configured to harvest RF energy, for example, from a transmitting wireless communication network device. In an illustrative example, various embodiment lighted artificial tree designs may retain batteries in an artificial tree trunk section. In various embodiments, the battery may be retained in a container or holder adapted to maintain electrical polarity operable to power the lighted artificial tree. In an illustrative example, an embodiment battery holder or battery container may be configured to retain the batteries in right-side up or up-side down orientation within the battery holder or battery container, while retaining polarity operable to power the lighted artificial tree. In some embodiment battery holder or battery container designs, an exemplary battery holder or battery container may be stacked to have the batteries in parallel or series based on rotating the holders to one another. In various examples, embodiment lighted artificial tree designs may retain batteries in the tree sections with the sections interconnected for common charging. In some illustrative designs exemplary of various embodiment lighted artificial trees, a single set of batteries may be retained within a single tree stand tube of a smaller tree.

In some examples, various embodiment lighted artificial tree implementations may include batteries housed in the tree stand tube. Some embodiment lighted artificial tree designs may include batteries housed in the bottom section of the tree tube. In various embodiment lighted artificial tree examples, batteries may be housed in each interconnected tree trunk section of the tree tubes with leads connected to connectors outside the tube. In some exemplary lighted artificial tree embodiment implementations, batteries may be housed in each interconnected tree trunk section of the tree tubes with leads connected to a Fiber Optic LED inside the tube. In various embodiment lighted artificial tree designs, batteries may be housed in a tree trunk section with leads connected to a combination of connectors outside the tube, and a Fiber Optic LED inside the tube.

In some embodiments, a method or apparatus to rotationally and optically couple electrically connected artificial tree trunk sections to electrical power and light sources disposed in a base are described using optical, electrical, and mechanical techniques such as those disclosed with reference to: FIG. 1 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 1 of U.S. application Ser. No. 15/468,747 depicts an exemplary battery-powered lighted tree formed from an artificial tree trunk adapted to be mechanically supported and electrically connected to a support structure external to the tree, artificial tree branches extending from the trunk, a light source disposed to emit light from a branch and electrically connected to the trunk, and a base, formed from a battery, and, a structure adapted to mechanically support the trunk and electrically connect the trunk to the battery. In FIG. 1 of U.S. application Ser. No. 15/468,747, the base mechanically supports the lighted artificial tree via the structural support. The depicted base may electrically connect the lighted artificial tree to the battery holder. The battery holder may include an electrical connection to a battery which may be retained within the battery holder. In various embodiments, the lighted artificial tree may be composed from rotationally coupled sections electrically connected with the battery holder in the base, and optically coupled with a light source disposed in the base to illuminate the tree. The battery holder may be in the form of a gift box disposed below the lighted artificial tree. The lighted artificial tree may electrically connect the light source to the battery holder. In some embodiments, the light source may be an LED (Light Emitting Diode) light source. The light source may be disposed within the base and optically coupled with optic fibers configured to illuminate the lighted artificial tree. The mini-LEDs and flash-able mini-LEDs may be electrically connected to the battery holder by the lighted artificial tree and configured to illuminate the lighted artificial tree. The light source may be optically coupled with the tree fibers. The tree fibers may be disposed to emit visible light from the lighted artificial tree surface. In an illustrative example, apparatuses and methods to rotationally and optically couple electrically connected artificial tree trunk sections to electrical power and light sources disposed in a base are described using optical, electrical, and mechanical techniques such as those disclosed with reference U.S. Provisional Patent Application No. 62/406,132 entitled "EVIRO-LIGHTS TREE," filed by Michael M. McRae on Oct. 10, 2016, the entire contents of which are herein incorporated by reference.

In some embodiments, a method or apparatus to structurally support a lighted artificial tree are described using electromechanically-based techniques such as those disclosed with reference to: FIG. 2 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 2 of U.S. application Ser. No. 15/468,747 depicts a cross-sectional side view of an embodiment battery-powered lighted tree base that is not illuminated; in the disclosed embodiment, the exemplary base illuminates the tree fiber optics that exit the tree trunk. The depicted base structural support mechanically supports the trunk support rib retaining the trunk collar. In an exemplary scenario of use the trunk collar may secure an artificial tree trunk inserted within the trunk collar. In the depicted embodiment, snap tabs removably attach the base structural support to the trunk support rib. In the depicted embodiment, battery leads electrically connect the light source to the battery. The base may include the control circuit. The control circuit may be adapted to activate the light source to emit various illumination patterns and sequences. The control circuit may be operably coupled with the light source and electrically connected to the battery. The bottom of the base may be supported by feet and secured by screws to the base plate.

In some embodiments, a method or apparatus to structurally support a lighted artificial tree are described using electromechanically-based techniques such as those disclosed with reference to: FIG. 3 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 3 of U.S. application Ser. No. 15/468,747 depicts a bottom view of an embodiment battery-powered lighted tree base structural support. In some embodiments, the base may be not illuminated. The depicted structural support extends to the bottom of the base to mechanically secure the trunk support rib and retain the tree trunk tube. The structural support may be securable to the base via the screw hole.

In some embodiments, a method or apparatus to configure and control powered artificial tree light source illumination is described using electrical and computer-implemented controller-based techniques such as those disclosed with reference to: FIG. 4 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 4 of U.S. application Ser. No. 15/468,747 depicts a perspective side view of an embodiment battery-powered lighted tree base. The depicted base is configured with a battery compartment to provide access to a battery retainable within the battery controller and housing. The connectors may provide electrical connection from the battery controller and housing to a lighted artificial tree which may be attached to the base in an exemplary scenario of use. In some embodiments, the battery controller and housing may include a control circuit adapted to activate various illumination patterns and sequences emitted from an attached lighted artificial tree. In the depicted embodiment, the switch may be operably coupled with the battery controller and housing to activate and control illumination of an attached lighted artificial tree. The foot switch may be operably coupled via a control cable with the battery controller and housing to activate and control illumination of an attached lighted artificial tree. An additional battery unit may provide electrical connection attachable to a battery retainable within the battery controller and housing in exemplary scenarios of use. The additional battery interconnect cable may electrically connect additional battery units, bridging the structural support. In an illustrative example, embodiment designs having series or parallel electrical connection of additional battery units are contemplated. In the depicted embodiment, a tree stand securing hook securely connects the structural support to the base.

In some embodiments, a method or apparatus to structurally support and power a lighted artificial tree is described using electromechanically-based techniques such as those disclosed with reference to: FIG. 5 of U.S. application Ser. No. 15/468,747, titled "BATTERY-POWERED TREE,"

filed on Mar. 24, 2017 by National Tree Company, Michael M. McRae, Inventor; the entire contents of which are herein incorporated by reference. FIG. 5 of U.S. application Ser. No. 15/468,747 depicts a top view of an embodiment battery-powered lighted tree base formed from quarter-sections. In various embodiments, the base may be not illuminated. The depicted tree securing screw may be rotationally tightened to horizontally secure an artificial tree attached to the base in exemplary scenarios of use. The unit J-bolt may removably attach the structural support to the base. The battery interconnect connectors may electrically connect additional battery units via connectors and additional battery interconnect cable. The additional battery units may be accessible via battery compartments. The base may be composed of quarter-sections. Four quarter-section battery compartments may provide access to battery, illumination, and control apparatus configured to activate lighting patterns and sequences in an illuminated artificial tree attachable to the base in exemplary scenarios of use. A pattern-plus-power switch and foot pedal connector may be operably coupled with the quarter-section battery and control tree base unit to activate and control illumination of a lighted artificial tree attachable to the base.

In some embodiments, a method or apparatus to configure a powered artificial tree with battery units is described using electromechanically-based techniques such as those disclosed with reference to: FIG. 6 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 6 of U.S. application Ser. No. 15/468,747 depicts a perspective bottom view of an embodiment battery-powered lighted tree base quarter-section. The depicted quarter-section battery and control tree base unit retains additional battery units electrically connected via additional battery interconnect cable to power an attachable illuminated artificial tree in exemplary scenarios of use. In some embodiments, more than one quarter-section battery and control tree base unit may be interconnected to form a base. In the depicted embodiment, the quarter-section battery and control tree base unit may be removably attachable with another like unit via mechanical connection of bracket and securing screw. The mounting hardware channel may retain the bracket which may, for example, interlock more than one quarter-section battery and control tree base unit to form a base, as depicted, for example, in U.S. application Ser. No. 15/468,747 FIGS. 4 and 5. In various embodiments, more than one quarter-section battery and control tree base unit may be secured to the structural support to form a base, using a stand j-hook securing assembly.

In some embodiments, a method or apparatus to configure a powered artificial tree with battery units and controllable light sources is described using electromechanically-based techniques such as those disclosed with reference to: FIG. 7 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. The depicted exemplary electrical and control interconnect design uses an embodiment battery-powered lighted tree base quarter-section. The quarter-section battery and control tree base unit retain the additional battery unit and battery compartment electrically connected via connectors with the flash-able mini-LEDs. The foot switch and pattern-plus-power switch may be operably coupled with the flash-able mini-LEDs to activate various illumination patterns and sequences. The remote control may be communicatively coupled with the quarter-section battery and control tree base unit to activate various illumination patterns and sequences. The multiple quarter-section battery and control tree base units may be secured to the structural support to form a base, using a tree stand securing hook. In the illustrated embodiment, optic fibers may be plugged into the top of LED can light. The LED can light may include an LED light source optically coupled with the optic fibers.

In some embodiments, a method or apparatus to illuminate an artificial tree with stray light emitted from an artificial tree light source is described using electromechanically- and optically-based techniques such as those disclosed with reference to: FIG. 8 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 8 of U.S. application Ser. No. 15/468,747 depicts top and front views of an embodiment lighted tree base retaining an exemplary battery holder. The depicted base retains the light source. The light source may be operably and electrically connected to the battery via battery leads. The base window may conduct stray light emitted from the light source. The opaque picture may be illuminated with the stray light emitted from the light source. The opaque picture may be removably attached to the base via the picture securing rail. The base internal components may be accessible via attach-ably removable lid. One or more batteries may be removably secured by the battery holder. The attached feet may physically support the base. The tree trunk tube may enable attachment of a lighted artificial tree to the base.

In some embodiments, a method or apparatus to conceal a battery configured to power a lighted artificial tree is described using electromechanically-based techniques such as those disclosed with reference to: FIG. 9 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 9 of U.S. application Ser. No. 15/468,747 depicts a perspective view of an embodiment lighted tree battery holder. The depicted battery is concealed within a battery holder disguised as a boxed gift placed near a battery-powered illuminated artificial tree. The gift box may conceal the battery beneath the lid removably attached by the lid latch mechanism. The latch detent secures the lid in a closed position. Operating the bow switch may electrically connect the battery to illuminate an attached lighted artificial tree. The lid latch mechanism may be mechanically engaged with the ribbon latch providing a handle operably engaging and disengaging the lid latch to access the battery. The decorative ribbon may further enhance the battery holder disguise. In an illustrative example, the battery may be an AA battery or a AAA battery. In the illustrated embodiment, the battery may be electrically connected to an attached lighted artificial tree via electrical continuity with contact strips retained within the gift box.

In some embodiments, a method or apparatus to conceal a battery configured to power a lighted artificial tree is described using electromechanically-based techniques such as those disclosed with reference to: FIG. 10 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 10 of U.S. application Ser. No. 15/468,747 depicts a perspective view of an embodiment lighted tree battery holder. The depicted battery is retained within the battery holder and concealed beneath the lid. The battery may be a lantern battery. The lid may be removably attached by the lid latch mechanism. Operating the bow switch may electrically connect the battery to illuminate an attached lighted artificial tree. The lid latch mechanism may be mechanically engaged with the ribbon latch providing a handle operably engaging and disengaging the lid latch to access the battery. The decorative ribbon may further enhance the battery holder disguise. The battery may be electrically connected to an attached lighted artificial tree via electrical continuity with the lantern battery spring terminal. The lantern battery holder support strap may mechanically reinforce the disguised battery holder to more securely retain the heavier lantern battery. The decorative ribbon strap may aid in concealing the lid latch mechanism.

In some embodiments, a method or apparatus to conceal a battery configured to power a lighted artificial tree is described using electromechanically-based techniques such as those disclosed with reference to: FIG. 11 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 11 of U.S. application Ser. No. 15/468,747 depicts a perspective view of an embodiment lighted tree battery holder. The depicted lid conceals internal components of a battery holder disguised as a boxed gift with the externally attached decorative ribbon. The decorative ribbon strap may aid in concealing the lid. A battery retained within the disguised battery holder may be electrically connected to illuminate a lighted artificial tree via electrical continuity with terminal. The lead and the spring terminal may be electrically connected to the terminal. An electrical connection to a battery retained within the disguised battery holder may be maintained by mechanical contact pressure to the terminal by the spring connecting strap. The terminal may be mechanically secured within the battery holder via attachment by a screw. A spring hinge may positively retract the lid to the closed position to enhance safety by avoiding inadvertent human contact with electrical components including the controls.

In some embodiments, a method or apparatus to conceal a battery configured to power a lighted artificial tree is described using electromechanically-based techniques such as those disclosed with reference to: FIG. 12 of U.S. application Ser. No. 15/468,747, titled "BATTERY-POWERED TREE," filed on Mar. 24, 2017 by National Tree Company, Michael M. McRae, Inventor; the entire contents of which are herein incorporated by reference. FIG. 12 of U.S. application Ser. No. 15/468,747 depicts a perspective view of an embodiment lighted tree battery holder. The depicted battery is concealed by the lid within a battery holder disguised as a boxed gift by the decorative ribbon and the decorative ribbon strap. The battery may be a variety of sizes based on power requirements. The pattern-plus-power switch may operably engage controls to electrically couple the battery to an attached lighted artificial tree, to activate the tree to emit various illumination patterns and sequences.

In some embodiments, a fiber optic tree may be illuminated by two led arrays in cans that have the optical fibers plugged into the top of the cans. In various designs, the power for these LEDs may be supplied by 12 "d" cell batteries (18 VDC), thru a control and sequencing switch. In various implementations, the system may operate with sufficient light for 28 days at 5 to 6 hours a day. In an illustrative example, the brightness may slowly deteriorate over time as all battery powered led strings do. In some designs, such as wreaths, baskets, or swags, an effective illumination may be obtained for about 10 to 20 days at 5 to 6 hours a day of operation. However, in various examples, a tree with a larger quantity of batteries may have to run for a longer period of time to avoid customer dissatisfaction, based on replacing the batteries more than once in a season, for average usage. In view of this, in some embodiments, a goal may be to develop a lighting system that would last on batteries for 4 weeks, at 5 to 6 hours per day of illumination. In some designs, "glitter" LED lights may last for extended periods with "D" cell batteries, even with large quantities of lights. In some designs, 4 sets of 66 "glitter" lights may be used, with each set having its own control for 18 Volts DC. In an illustrative example, glitter lights may be easy to work with, but may need to have more space between LEDs to be used in a prelit tree. In various implementations, "glitter" led strings could be used for lighting a tree if a larger tree is considered.

In some designs, mini led strings (140 LEDs) using 6 "D" cell batteries, or 210 LEDs with 9 "D" cell batteries, may be advantageously employed to obtain a sufficient period of illumination. In various embodiments, a series of housings for the batteries and LED controls may be formed from quarter sections that clamp on to the legs of a standard tree stand. In some embodiments, the first base unit houses the controls, and a first set of batteries. In various designs, added sections are for additional batteries that may be needed depending on the number and size of the batteries required. In an illustrative example, this design has flexibility for adjustment to fit a variety of tree stands within a reasonable size range.

In some embodiments, the battery/lighting systems of different led and fiber optic products may be adapted to select battery and lighting to meet customer expectations for brightness and longevity. In some designs, a fiber optic tree may be lit by two cans containing LEDs and a color changing circuit, added in parallel to the power supplying batteries are several strings of flashing tiny "infinity" or "glitter" type LEDs. In an illustrative example, a consideration for this type of tree may be the container for the battery/batteries. In some designs, a container for the battery/batteries may be implemented in the form of decorative "gift boxes" containing batteries and controls, with battery contacts and electrical connections to power the tree.

In the Summary above and in this Detailed Description, and the Claims below, and in the accompanying drawings, reference is made to particular features of various embodiments of the invention. It is to be understood that the disclosure of embodiments of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

In the present disclosure, various features may be described as being optional, for example, through the use of the verb "may;" or, through the use of any of the phrases: "in some embodiments," "in some implementations," "in some designs," "in various embodiments," "in various implementations," "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In various embodiments. elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of embodiments of the invention, even those disclosed solely in combination with other features of embodiments of the invention, may be combined in any configuration excepting those readily apparent to the person skilled in the art as nonsensical. Likewise, use of the singular and plural is solely for the sake of illustration and is not to be interpreted as limiting.

In the present disclosure, all embodiments where "comprising" is used may have as alternatives "consisting essentially of," or "consisting of" In the present disclosure, any method or apparatus embodiment may be devoid of one or more process steps or components. In the present disclosure, embodiments employing negative limitations are expressly disclosed and considered a part of this disclosure.

Certain terminology and derivations thereof may be used in the present disclosure for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an embodiment "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 of U.S.C. § 112 (f). Specifically, any use of "step of" in the claims herein is not intended to invoke the provisions of 35 of U.S.C. § 112 (f).

According to an embodiment of the present invention, the system and method may be accomplished through the use of one or more computing devices. In an illustrative example, one of ordinary skill in the art would appreciate that an exemplary system appropriate for use with embodiments in accordance with the present application may generally include one or more of a Central processing Unit (CPU), Random Access Memory (RAM), a storage medium (e.g., hard disk drive, solid state drive, flash memory, cloud storage), an operating system (OS), one or more application software, a display element, one or more communications means, or one or more input/output devices/means. Examples of computing devices usable with embodiments of the present invention include, but are not limited to, proprietary computing devices, personal computers, mobile computing devices, tablet PCs, mini-PCs, servers or any combination thereof. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In various embodiments, communications means, data store(s), processor(s), or memory may interact with other components on the computing device, in order to effect the provisioning and display of various functionalities associated with the system and method detailed herein. One of ordinary skill in the art would appreciate that there are numerous configurations that could be utilized with embodiments of the present invention, and embodiments of the present invention are contemplated for use with any appropriate configuration.

According to an embodiment of the present invention, the communications means of the system may be, for instance, any means for communicating data over one or more networks or to one or more peripheral devices attached to the system. Appropriate communications means may include, but are not limited to, circuitry and control systems for providing wireless connections, wired connections, cellular connections, data port connections, Bluetooth connections, or any combination thereof. One of ordinary skill in the art would appreciate that there are numerous communications means that may be utilized with embodiments of the present invention, and embodiments of the present invention are contemplated for use with any communications means.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("disclosed functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description may set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a sequence of computational instructions or program instructions. It will be appreciated that a programmable apparatus (i.e., computing device) can receive such a computer program and, by processing the computational instructions thereof, produce a further technical effect.

A programmable apparatus may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the disclosed functions. This particular machine provides a means for carrying out any and all of the disclosed functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

In some embodiments, computer program instructions may be stored in a computer-readable memory capable of directing a computer or other programmable data processing apparatus to function in a particular manner. The instructions stored in the computer-readable memory constitute an article of manufacture including computer-readable instructions configured to implement any and all of the disclosed functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the disclosed elements and the functions thereof may be implemented as parts of a monolithic software structure, as standalone software modules, or as modules that employ external routines, code, services, and so forth, or any combination of these. All such implementations are within the scope of the present disclosure.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A lighted tree, comprising:

a tree trunk section adapted to be mechanically supported by a support structure external to the tree and configured to subsume a substantially elongated structure inserted into the trunk section;

a plurality of artificial tree branches extending from the trunk section;

at least one light source electrically connected to the trunk section and disposed to emit light from an LED string on tree branches; and a battery holder, adapted to be inserted into the tree trunk section, and configured to power the lighted tree trunk section with a battery retained within the battery holder;

wherein the battery holder includes an end cap including electrical contacts configured to maintain the battery holder electrical polarity independent of the orientation of the battery retained within the battery holder.

2. The lighted tree of claim 1, wherein the battery holder further comprises:

an elongated structure section, open at one end, and adapted to releasably attach the end cap.

3. The lighted tree of claim 1, wherein the lighted tree further comprises: a lighted tree base that is not illuminated, comprising: a support structure adapted to mechanically support the trunk section.

4. The lighted tree of claim 1, wherein the lighted tree further comprises at least two electrically and mechanically interconnected trunk sections.

5. The lighted tree of claim 1, wherein the lighted tree further comprises: a lighted tree base that is not illuminated, comprising: the support structure adapted to mechanically support at least three interconnected trunk sections.

6. The lighted tree of claim 1, wherein the battery is rechargeable.

7. The lighted tree of claim 6, wherein the lighted tree further comprises a multifrequency ambient energy harvester module electrically and operably coupled to charge the battery retained within the battery holder.

8. The lighted tree of claim 6, wherein the lighted tree further comprises a photovoltaic collector electrically and operably coupled to charge the battery retained within the battery holder.

9. A lighted tree, comprising:

at least two electrically and mechanically interconnected trunk sections adapted to be mechanically supported by a support structure external to the tree and configured to subsume a substantially elongated structure inserted into at least one trunk section;

a plurality of artificial tree branches extending from each trunk section;

at least one light source electrically connected to each trunk section and disposed to emit light from LEDs on a branch;

a lighted tree base that is not illuminated, comprising: the support structure adapted to mechanically support the interconnected trunk sections; and, a battery holder, adapted to be inserted into at least one tree trunk section, and configured to power the lighted tree trunk section with a battery retained within the battery holder;

wherein the battery holder further comprises an end cap including electrical contacts configured to universally connect a plurality of interconnected battery holders retaining batteries in parallel or series based on rotating a first battery holder to a predetermined angular displacement with respect to a second battery holder.

10. The lighted tree of claim 9, wherein the energy source external to the lighted tree further comprises a multifrequency Radio Frequency (RF) energy harvester module.

11. The lighted tree of claim 9, wherein the energy source external to the lighted tree further comprises a photovoltaic collector.

12. The lighted tree of claim 9, wherein the electrical contacts are configured to maintain the first and second battery holder electrical polarity independent of the orientation of the batteries.

13. A lighted tree, comprising:

at least two electrically and mechanically interconnected trunk sections adapted to be mechanically supported by a support structure external to the tree and configured to subsume a substantially elongated structure inserted into at least one trunk section;

a plurality of artificial tree branches extending from each trunk section;

at least one light source electrically connected to each trunk section and disposed to emit light from LEDs in a branch;

a base, comprising: the support structure adapted to mechanically support the interconnected trunk sections; and, a battery holder, adapted to be inserted into at least one tree trunk section, configured to power the lighted tree trunk section with a batteries retained within the battery holder, and configured to operably couple the batteries retained within the battery holder with an energy source external to the lighted tree;

wherein the battery holder further comprises a universal arrangement of contacts to allow parallel or series connections while the battery compartments are above one another.

14. The lighted tree of claim 13, wherein the lighted tree further comprises another battery housed in the base operably configured to power the lighted tree.

15. The lighted tree of claim 13, wherein the base further comprises sensors adapted to configure the lighted tree illumination controlled as a function of signals transmitted by a wireless remote control.

16. A lighted tree, comprising:

at least two electrically and mechanically interconnected trunk sections adapted to be mechanically supported by a support structure external to the tree and configured to subsume a substantially elongated structure inserted into at least one trunk section;

a plurality of artificial tree branches extending from each trunk section;

at least one light source electrically connected to each trunk section and disposed to emit light from LEDs in a branch;

a base, comprising: the support structure adapted to mechanically support the interconnected trunk sections; and, a battery holder, adapted to be inserted into at least one tree trunk section, configured to power the lighted tree trunk section with a battery retained within the battery holder, and configured to operably couple the battery retained within the battery holder with an energy source external to the lighted tree;

wherein the battery holder further comprises contacts adapted to permit the battery retained within the battery holder to be reversed while maintaining the same polarity.

17. The lighted tree of claim 16, wherein the base further comprises sensors adapted to configure the lighted tree illumination controlled as a function of signals transmitted by a wireless remote control.

* * * * *